US007509984B2

(12) United States Patent
Schwaiger et al.

(10) Patent No.: US 7,509,984 B2
(45) Date of Patent: Mar. 31, 2009

(54) MORTISER AND ACCESSORIES THEREFOR

(75) Inventors: Barry M. Schwaiger, Hampshire, IL (US); William J. Phillips, Bolingbrook, IL (US)

(73) Assignee: WMH Tool Group, Inc., Elgin, IL (US)

( * ) Notice: Subject to any disclaimer, the term of this patent is extended or adjusted under 35 U.S.C. 154(b) by 0 days.

(21) Appl. No.: 11/299,479

(22) Filed: Dec. 12, 2005

(65) Prior Publication Data

US 2006/0157154 A1 Jul. 20, 2006

Related U.S. Application Data

(60) Provisional application No. 60/635,895, filed on Dec. 14, 2004.

(51) Int. Cl.
*B27F 5/10* (2006.01)

(52) U.S. Cl. ..... 144/82; 144/75; 144/135.2

(58) Field of Classification Search ..... 144/67–71, 144/74–76, 78, 79, 82, 83, 92, 286.5, 253.6, 144/253.7, 253.8, 134.1, 135.2; 409/18, 409/124, 128, 111, 135, 136, 234, 87; 483/66; 269/305, 315

See application file for complete search history.

(56) References Cited

U.S. PATENT DOCUMENTS

| | | | | | |
|---|---|---|---|---|---|
| 1,471,993 | A * | 10/1923 | Wilderson | 144/78 |
| 2,334,830 | A * | 11/1943 | Mansfield | 144/78 |
| 2,576,485 | A | 11/1951 | Schwandt | |
| 3,249,839 | A * | 5/1966 | Fay | 388/819 |
| 3,599,302 | A * | 8/1971 | Dudek | 29/36 |
| 3,822,961 | A * | 7/1974 | Lay | 408/236 |
| 3,894,809 | A * | 7/1975 | Hollins | 408/128 |
| 4,499,933 | A * | 2/1985 | Thompson | 144/135.2 |
| 5,517,746 | A * | 5/1996 | Cox et al. | 29/560 |
| 5,634,748 | A | 6/1997 | Brazell et al. | |
| 6,309,148 | B1 * | 10/2001 | Wang | 408/87 |
| 6,360,798 | B1 * | 3/2002 | Apolinski | 144/286.5 |
| 6,516,842 | B1 | 2/2003 | Chang | |
| 7,210,386 | B1 | 5/2007 | Chang | |
| 7,243,692 | B2 | 7/2007 | Chang | |
| 2002/0177388 | A1 | 11/2002 | Hinch | |
| 2003/0024600 | A1 | 2/2003 | Chang | |
| 2007/0113926 | A1 | 5/2007 | Chang | |

OTHER PUBLICATIONS

Extended European Search Report of the European Patent Office for corresponding European Application No. EP 05 02 7383.8 dated Jul. 6, 2006 (8 pages).

Erickson, Ben, Hollow-Chisel Mortising, Boring Square Holes On The Drill Press, Fine Woodworking, Taunton Press, Newtown, Connecticut, No. 83, Jul./Aug. 1990, pp. 52-56.

The Jet Group Full Line Catalog, WMH Tool Group, Inc., Apr. 2001, 4 pages.

Operating Instructions and Parts Manual, Tilting Table Hollow Chisel Mortiser Model 719T, WMH Tool Group, Inc., Revision A Mar. 2004, 20 pages.

Jim Pollock and Kevin Boyle, Master the Mortise-and-Tenon, Wood Magazine, Jun./Jul. 2004, Issue 156, pp. 68-73.

(Continued)

*Primary Examiner*—Shelley Self

(74) *Attorney, Agent, or Firm*—Fitch, Even, Tabin & Flannery

(57) ABSTRACT

A power tool and accessories therefor including a variable speed motor for a mortiser, an integrated chisel positioning tool for positioning a chisel in a desired position, and an integrated tool sharpening device mounted directly on the power tool to permit ease and efficiency in the sharpening of tools. Additionally, an improved clamping arrangement is provided that permits firm clamping of a work piece without slippage. Greater flexibility in the hold down may be achieved by using arms for the hold down that are both rotatable about and can be translated along respective horizontal axes.

44 Claims, 19 Drawing Sheets

OTHER PUBLICATIONS

Dave Campbell and Jeff Hall, Benchtop Mortisers, Wood Magazine, Jun./Jul. 2004, Issue 156, pp. 78-83.

Dave Campbell, Hot New Tools for 2006, Wood Magazine, Dec./Jan. 2005/2006, Issue 167, pp. 80-82.

* cited by examiner

MORTISER AND ACCESSORIES THEREFOR

CROSS-REFERENCE TO RELATED APPLICATIONS

This application claims the benefit of U.S. Provisional Application No. 60/635,895, filed Dec. 14, 2004, which is hereby incorporated by reference herein in its entirety.

BACKGROUND OF THE INVENTION

The present invention relates to an improved power tool, and more particularly, an improved mortiser and accessories therefor.

Power tools, such as hollow chisel mortisers, come in various designs and arrangements. Generally, mortisers include a work table mounted on a base, which can be positioned on a stand or table, or on the ground, a support post which extends above the table and on which a motor for carrying a tool, such as a chisel, is mounted for movement of the chisel in a vertical direction towards and away from the working surface of the table. Additionally, a fence disposed perpendicular to the table's surface is mounted on the table for movement along the table, and a material stop or hold down mechanism, generally mounted on or to the rear of the fence, is provided for holding down a workpiece on the table surface and/or against the fence. One problem with such hold-down mechanisms has been slippage while the mortiser is in use. Moreover, the range of vertical movement of the hold-down mechanism, in order to hold down various size workpieces to the table, is generally rather limited, particularly in the downward direction, in view of the interference with the vertical movement of the hold down mechanism caused by the fence. Additionally, the known hold-down mechanisms generally utilize a simple setscrew mechanism to hold a bracket used as a material stop. This leads to such hold-down mechanisms being prone to slippage, not being flexible in order to hold down various odd shaped workpieces, except with great difficulty, and having a mechanism that cannot extend close to the work table surface, and thus positively clamp relatively thin workpieces, except with the use of additional blocks or shims.

A further problem with known mortisers is that the motor utilized to drive the mortising tool (e.g., chisel and auger which may collectively be referred to hereinafter as a chisel), is in general a constant speed motor, and thus is not available for customization of the auger speed to an application. Thus, the use of a fixed speed for the mortising tool often leads to either high-speeds which may cause chisel "burn" or low-speeds which may cause unwanted resistance when using the mortiser. In addition, certain other variables of the use of the mortiser, including various chisel sizes, the hardness of the wood being mortised, the sharpness of the chisels, etc., are affected by the speed. However, current mortising machines do not provide for any mechanism for taking the motor speed into consideration.

In addition to the above, it has become customary in mortisers to provide a caddy for the mortising tools, as well as for other tools necessary for operation of the mortiser, directly on the mortiser in order to provide ease in changing chisels and/or making such tools readily available and accessible. One common problem with mortising tools is that they often need sharpening, which requires special tools. However, none of the mortisers currently available provide any arrangement for easing the steps of sharpening the chisels or provide any consideration for handling this problem.

DESCRIPTION OF THE PREFERRED EMBODIMENTS

Figure 1A:
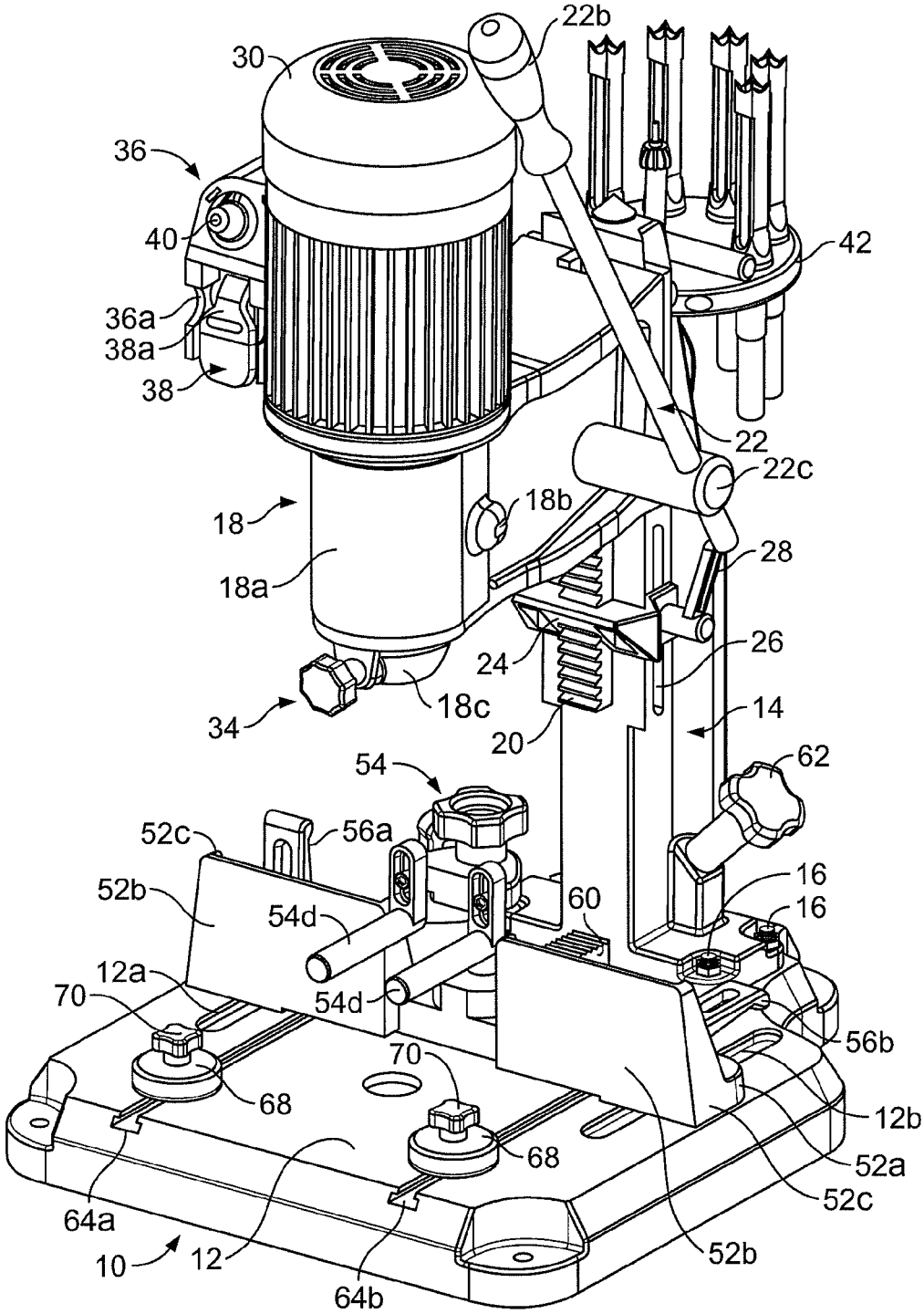
FIG. 1A is a perspective view of a mortiser according to the invention.
Figure 1B:
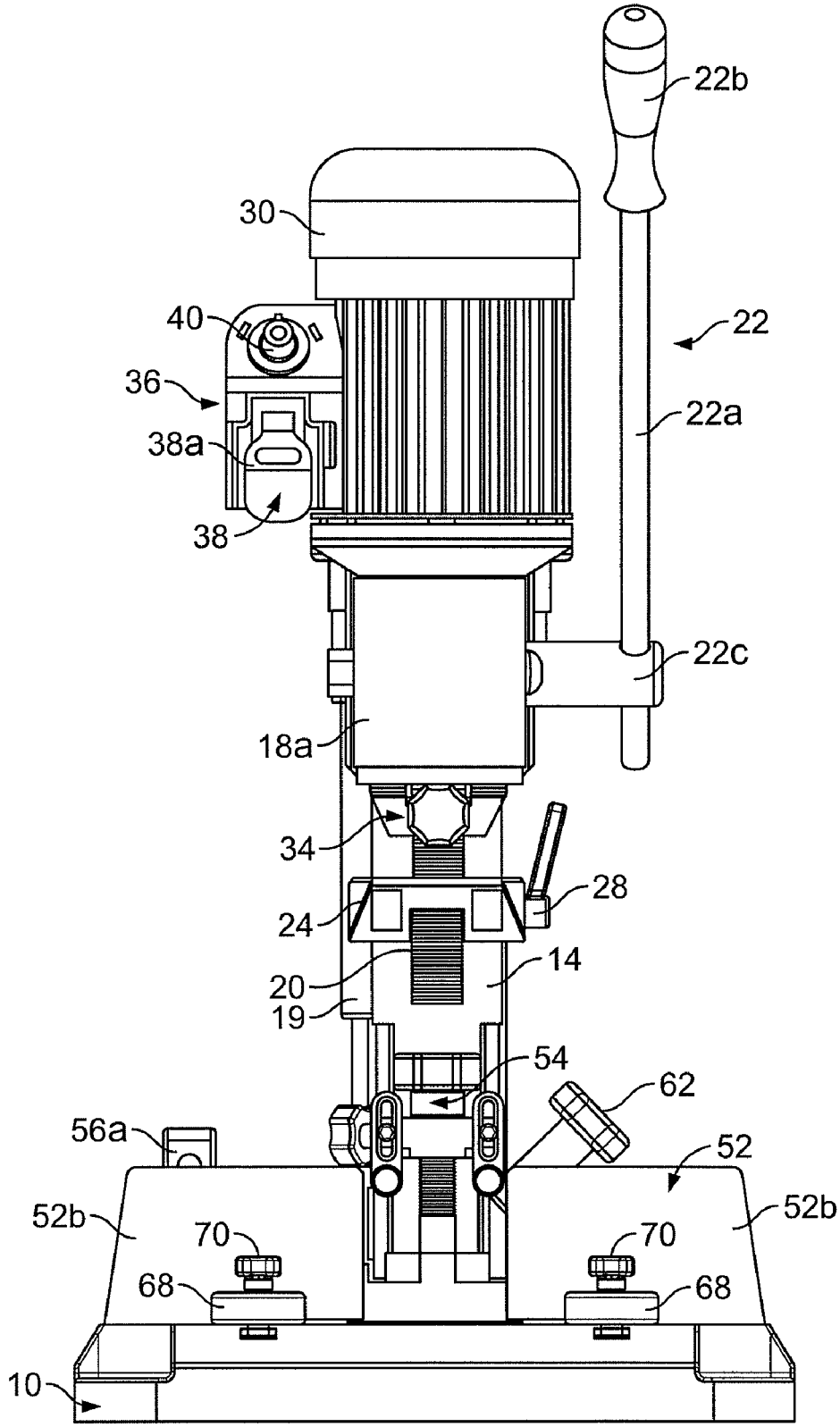
FIG. 1B is a front elevational view of the mortiser of FIG. 1A.
Figure 1C:
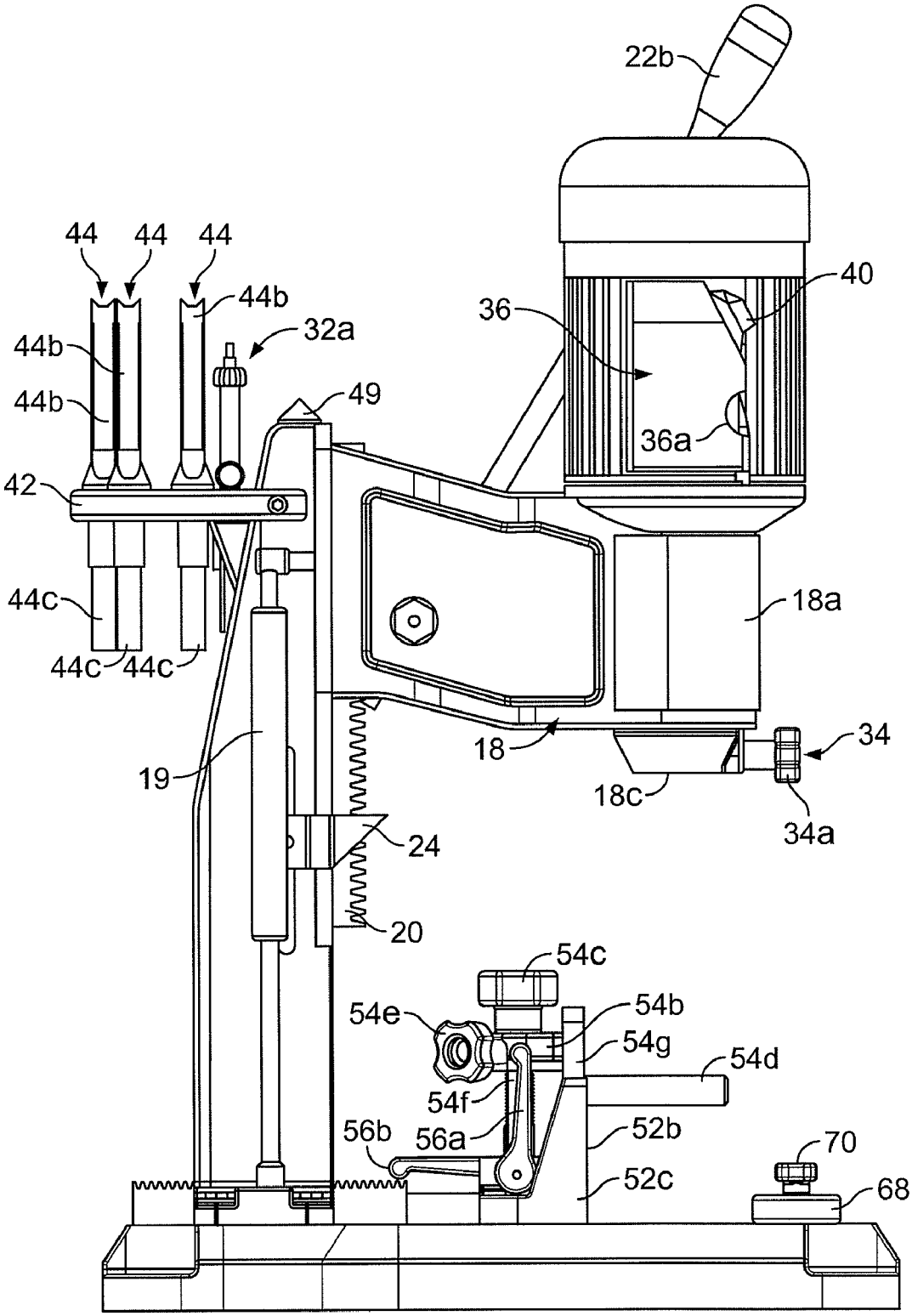
FIG. 1C is a side elevational view of the mortiser of FIG. 1A.

Turning now to FIGS. 1A-C, there is shown a mortiser having a base or work table 10 with a flat substantially rectangular upper work surface 12. It is to be noted that although the base 10 is illustrated as a unitary, one-piece structure, such is not required since the illustrated embodiment of the mortiser is for placing or mounting on a table, workbench or other support. That is, the actual base may be separated into parts, with a main base portion being supported by a secondary base portion, such as for example, a stand or enclosed cabinet which rest on the ground and position the main base portion at a desired vertical level. Additionally, it should be noted that it is also possible for the main base portion to be movable relative to the secondary base portion in any of the x, y and z directions, if desired.

The tool support or post 14 is mounted on the base 10 adjacent one end thereof, for example, by means of bolts 16, extending through and perpendicular to the surface 12. Like the base, it is also possible for the post 14 to be mounted so that it is movable relative to the base if desired. In the embodiment illustrated, however, the post 14 is fixed to the base 10 and the carriage 18 is slideably mounted on the post or tool support 14 for movement towards and away from the surface 12 (e.g., in the embodiment illustrated, the carriage 18 is movable in a vertical direction). Control of the position of the carriage 18 is achieved via a rack 20 mounted on the forward surface of the post or tool support 14, and engaged by a pinion gear (not shown) within the carriage 18. Movement of the gear is controlled via a lever 22, so that movement of the lever 22 in a downward direction will cause the carriage 18 to move downwardly, and vice versa. In the embodiment illustrated, the lever 22 has an elongated shaft 22*a* with an enlarged grip 22*b* located at the distal end thereof. The elongated shaft 22*a* is connected to a collar 22*c* that is secured to the axial shaft of the pinion gear.

In a preferred form, the mortiser 10 can be customized to the user so that a comfortable operation setting may be obtained. For example, the lever 22, including shaft 22*a*, enlarged grip 22*b* and cap or collar 22*c*, may be connected to the axial shaft of the pinion gear on either the left or right side of the carriage 18 to accommodate either left or right handed operators. In the embodiment illustrated, the collar 22*c* of lever 22 is fitted onto the axial shaft of the pinion gear like a socket and extends from the right side of the carriage, which is typically the position favored by most right-handed operators. In addition, the collar 22*c* of the lever 22 may be connected to the axial shaft of the pinion gear in a variety of positions with each position placing the elongated shaft 22*a* and grip 22*b* at a different angle with respect to the carriage 18. In this manner, the user or operator may place the elongated shaft 22*a* and grip 22*b* at an operating angle that is most comfortable to him or herself. In the embodiment illustrated, the collar 22*c*, and thus the shaft 22*a* and grip 22*b*, are positionable at sixty degree intervals about the axial shaft of the pinion gear. In alternate embodiments, the collar 22*c*, shaft 22*a* and grip 22*b* may be positionable at other angles.

The length of the lever 22 may also be adjusted to allow operators to further customize the mortiser. For example, in the embodiment illustrated, the elongated shaft 22*a* is inserted into an opening defined by the collar 22*c* until the grip 22*b* has reached a desired distance from the collar 22*c* and then a fastener, such as a set screw (not shown), is inserted into an opening in the collar 22*c* that intersects the opening for shaft 22*a* and is screwed into engagement with the shaft 22*a* to secure the lever 22 into position. In this manner, the collar 22*c* forms a sleeve into which the shaft 22*a* is inserted and can be adjusted to any length desired. In alternate embodiments, the shaft 22*a* and the sleeve formed by collar 22*c* may be threaded to allow the length of the lever 22 to be adjusted by simply threading either more or less of the elongated shaft 22*a* into collar 22*c*.

In the embodiment illustrated, a lift mechanism, such as hydraulic cylinder 19, is provided to assist the operator in returning the carriage 18 to its uppermost limit of travel. The hydraulic cylinder 19 is connected at one end to base 10 and at the other end to carriage 18 and urges the carriage away from surface 12. By doing so, the cylinder 19 assists the user in removing chisels that have been inserted into a workpiece and in returning the carriage 18 to its upper or start position.

The depth of travel of the carriage 18 along the rack 20 may be controlled by a stop 24 that extends across the rack 20 and is mounted in a pair of opposed slots 26 formed in the opposite sidewalls of the post or support 14, and which can be locked into place by a locking lever or handle 28. In the embodiment illustrated, the stop 24 preferably has an opening through which the rack 20 may pass when the stop 24 is positioned up or down the post 14. This configuration allows the stop 24 to be secured at a desired depth along rack 20 and prevents the carriage 18 from being moved downward below this point. In an alternate embodiment, the stop 24 may also have a rear edge facing the rack 20, such that it can engage a tooth of the rack 20, thus providing a positive lock that securely locks the stop 24 in place against movement in a vertical direction even upon engagement by the carriage 18. With this configuration, the bore through which lock 28 passes may be designed to provide enough play to move the stop 24 forward, disengaging the rear edge from the tooth of the rack, so that the stop may be moved into a desired position along the rack 20.

In either embodiment, the stop 24 is in substantial alignment with the rack and pinion system and the force created thereby, thus, providing a stronger stop which is capable of preventing the carriage from jamming or racking. Such an in-line configuration overcomes the shortcomings associated with traditional stops, which usually include an offset configuration wherein the stop is positioned on a shaft mounted apart from and parallel to the support 14. More particularly, the offset configuration of traditional stops typically creates a coupling force which twists the carriage and may cause racking or jamming of the carriage on the rack 20. Such a configuration may also result in the bowing or bending of the shaft upon which the stop is positioned due to the stop shafts distance from the force applied by the rack and pinion system of the carriage causing the carrier and chisel to bind up and/or possibly even stick in a workpiece during operation. In the embodiment illustrated, however, the stop is positioned in-line with the force generated by the rack and pinion system and prevents such coupling forces that lead to binding or racking.

Figure 5A:
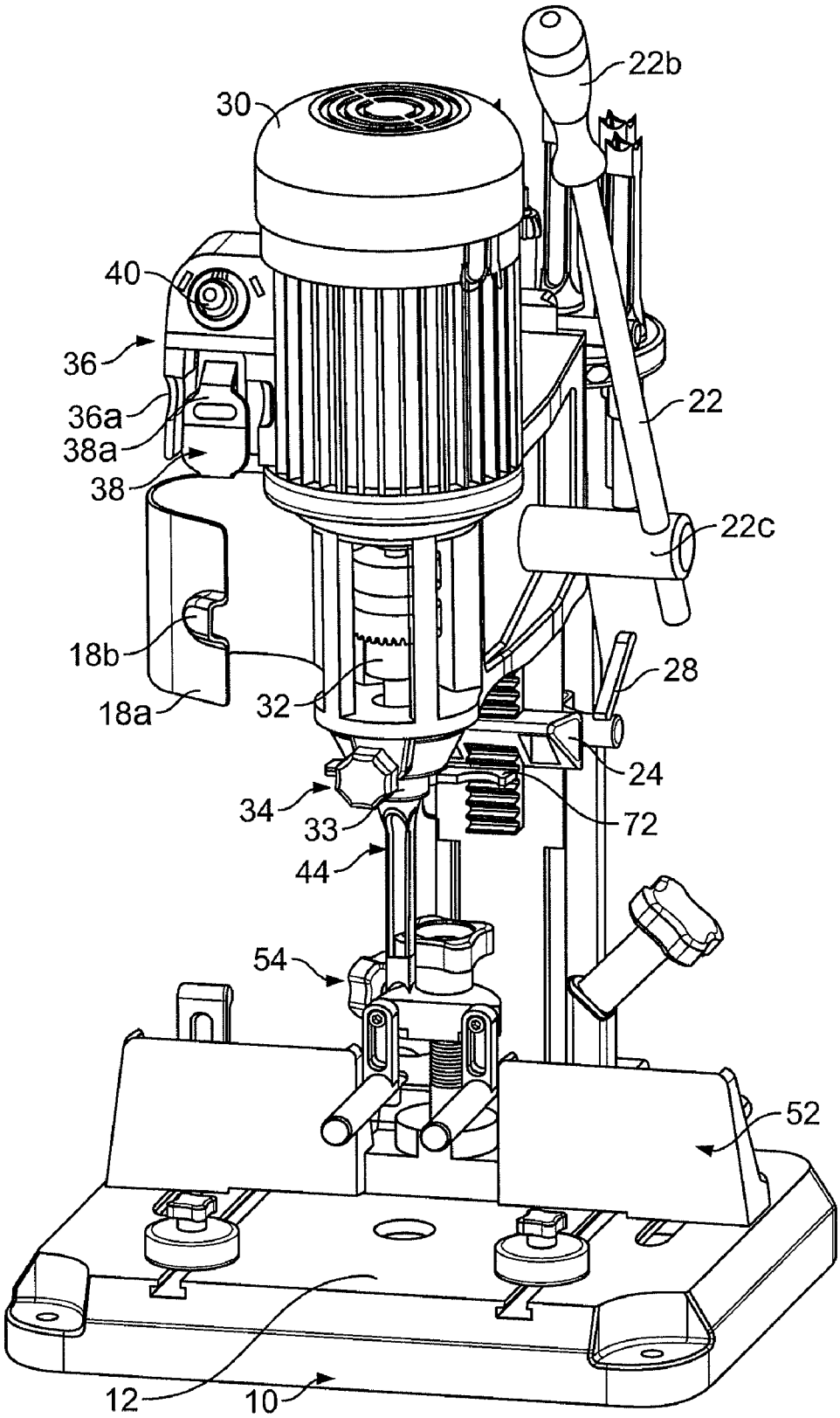
FIG. 5A is a perspective view of the mortiser of FIG. 1 showing a chuck access panel in its open position and a chisel positioning tool in accordance with the invention.

Mounted on the end of the carriage 18 opposite post or support 14, is an electric motor 30 having a chuck 32 (see FIG. 5A) located within an access panel 18*a* of carriage 18. The chuck 32 is used to hold and rotate the auger or drill bit 44*a* of the chisel assembly 44 and may be tightened or loosened using a chuck key in the embodiment illustrated, or using ones hands in an alternate keyless chuck embodiment. In a preferred form, the access panel 18*a* of carriage 18 includes a wide wrap-around door which is preferably hinged to the carriage 18 and has a magnetic lock or latch for securing the door when in its closed position. The access panel may also include a handle, such as raised lip or knob 18*b* which the operator may use to move the access panel between its open (FIG. 5A) and closed positions (FIG. 1A). The wide wrap-around access panel 18*a* allows the user to access the chuck 32 from the front, left or right, as illustrated in FIG. 5A, thereby making it easier to operate for both left handed and right handed operators, particularly when a chuck key is required to tighten or loosen the chuck 32.

The carriage 18 further defines an opening 18*c* for receiving a bushing 33 (see FIGS. 5A-C) into which at least a portion of the chisel assembly 44 is inserted. In a preferred form, the chisel housing 44*b* has a sleeve 44*c* that is inserted into the bushing 33 until the shoulder of the chisel sleeve 44*c* abuts the shoulder of the bushing 33. Before mounting the chisel housing 44*b*, the chisel housing 44*b* is lowered a desired amount depending on the type of chisel and workpiece the mortiser is being used with, such as for example between approximately 1/16" to 3/16", and the chisel is secured into position via a fastener, such as chisel lock 34. In the embodiment illustrated, chisel lock 34 is a setscrew with an integrated handle 34*a* which allows the chisel lock to be fastened without the need for additional tools. Thus, by rotating the chisel lock in one direction, the setscrew will pass through an opening in the annular wall of bushing 33 and engage the sleeve 44*c* of chisel housing 44*b* securing the chisel housing 44*b* in the bushing 33. Conversely, by rotating the chisel lock in the opposite direction, the setscrew will release the chisel sleeve 44*c* allowing the chisel housing 44*b* to be removed from the bushing 33 and eventually allowing the bushing 33 to be removed. In the embodiment illustrated, the toolless chisel lock 34 may be rotated in a clockwise direction to secure the bushing 33 and chisel housing 44*b* in position or rotated in a counter clockwise direction to release the chisel housing 44*b* and bushing 33. In alternate embodiments a chisel lock with a movable handle may be used to secure the bushing 33 and chisel housing 44*b* so that the handle can be moved to avoid interfering with the chuck access door 18*a* and/or the workpiece. For example, in one form, the chisel lock 34 may be provided with a pivoting handle so that the handle may be rotated one hundred and eighty degrees in case it is obstructing the path of the chuck access door 18*a*. In yet other embodiments, a slotted T-shaped handle, similar to those used on clamps or vises, or a ratcheting handle may be used so that the handle may be moved to avoid interfering with the mortiser or its components.

Figure 5B:
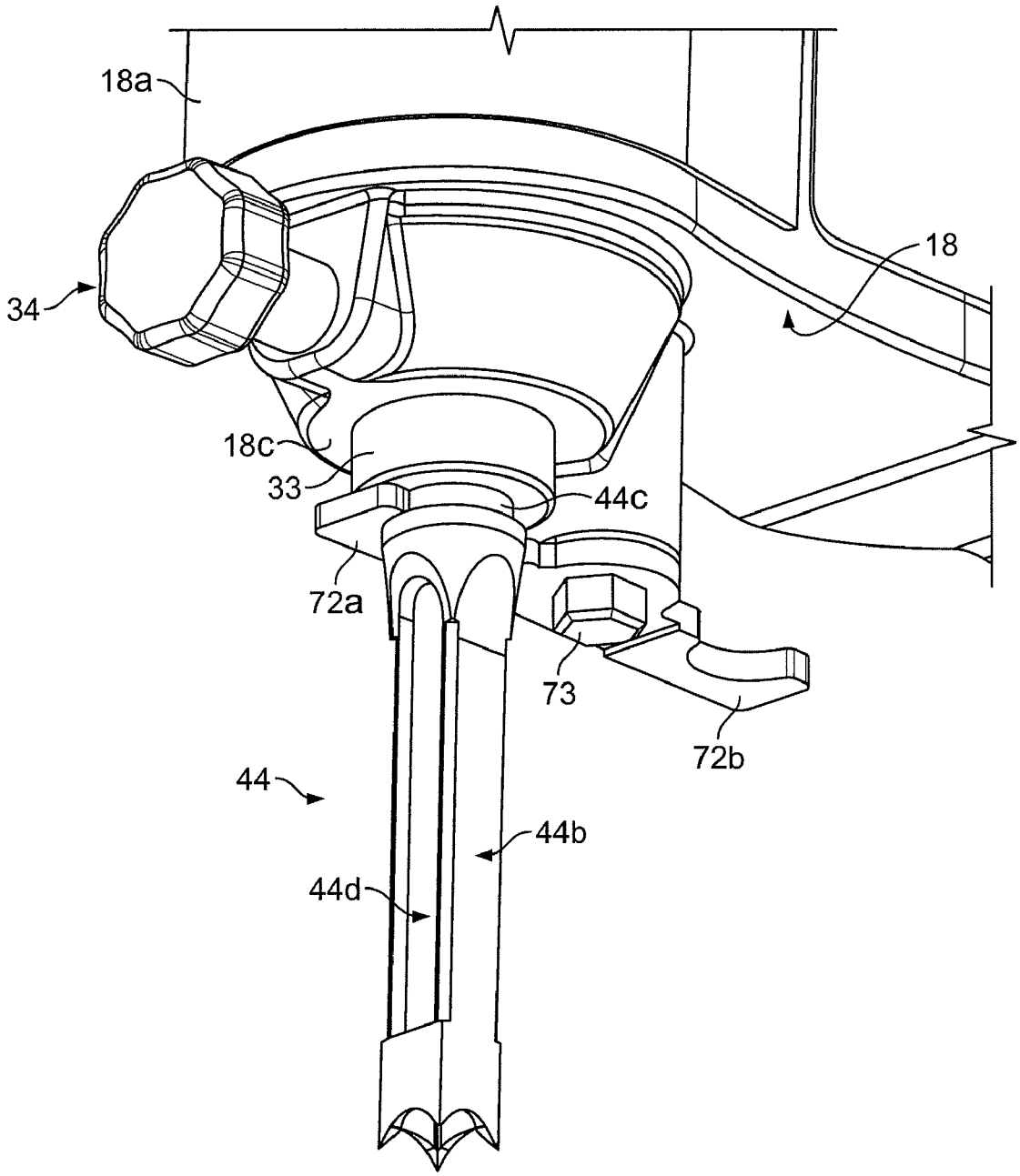
FIG. 5B is an enlarged perspective view of the mortiser of FIG. 5A showing the chisel positioning tool in a first position.
Figure 5C:
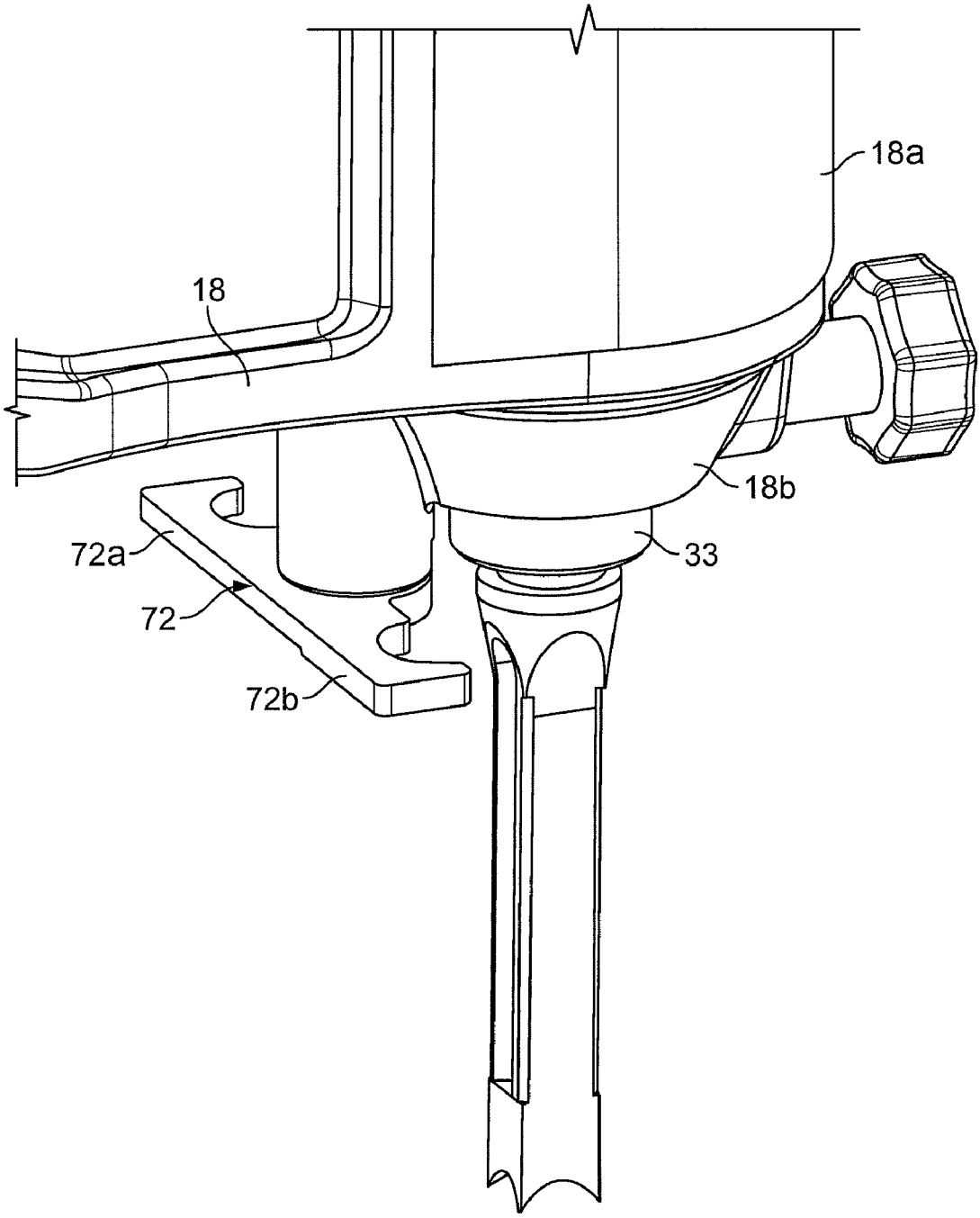
FIG. 5C is an enlarged perspective view of the mortiser of FIG. 5A showing the chisel positioning tool in a second position.

In one form, an integrated chisel offset tool may be provided to assist the operator in positioning the auger 44*a* and chisel housing 44*b* correctly with respect to the chuck 32 and bushing 33. For example, in FIGS. 5A-C, a chisel offset tool, such as spacer or jig 72, may be used by the operator to mount the chisel housing 44*b* in bushing 33 at a desired position. In the embodiment illustrated, spacer 72 is mounted to the carriage 18 so that it may be pivoted into alignment with the opening of bushing 33 and used to space the shoulder of chisel sleeve 44*c* from the bottom of bushing 33 as illustrated in FIG. 5B. More particularly, spacer 72 is a body having a first end 72*a* of a first desired thickness and a second end 72*b* of a second desired thickness, which may be moved to position either of the first or second ends in alignment with the opening of bushing 33. In a preferred embodiment, the ends of spacer 72 will be able to provide a range of spacing, such as for example spacing of a quarter inch or smaller. In the form illustrated, the first end 72*a* has a thickness of about 3 mm to provide a desired offset for smaller chisels and the second end 72*b* has a thickness of about 4 mm to provide a desired offset for larger chisels. Once the chisel housing 44*b* has been positioned and secured in bushing 33, the spacer 72 may be rotated out of alignment with the opening of bushing 33, as illustrated in FIG. 5C, so that the mortiser may be prepared for use.

It should be understood, however, that the integrated offset tool may take any shape and provide any desired amount of spacing for a particular application. In fact, in a preferred embodiment, spacer 72 is mounted to the carriage 18 via a removable fastener, such as bolt 73, so that the spacer may be removed and replaced with alternate spacers of differing size so that an operator may customize the mortiser and chisel spacing to his or her desired applications. In the form illustrated, spacer 72 defines a bore into which bolt 73 is inserted to fasten the spacer to carriage 18. The bolt 73 is tightened a sufficient amount to provide a frictional engagement between the spacer 72 and carriage 18 so that the spacer 72 may be rotated to place the first or second ends 72*a-b* in alignment with the opening of bushing 33 and so that the spacer 72 will remain in the position it is placed.

Once the chisel housing 44*b* has been secured in bushing 33, the auger 44*a* is pushed up into the chisel housing 44*b* and secured into position by tightening chuck 32 in any of the manners discussed above. In the form illustrated, chuck key 32*a* is used to tighten the chuck and secure the auger 44*a* therein. After the auger 44*a* is mounted in the chuck 32, the chisel lock 34 is released so that the chisel housing 44*b* may be inserted further into the bushing 33 to ensure that the auger 44*a* and chisel housing 44*b* are positioned properly for engaging the workpiece. More particularly, the remaining portion of the chisel sleeve 44*c* which was previously prevented from being inserted into the bushing 33 by the presence of spacer 72 will now be inserted into the bushing 33 so that the shoulder of the chisel housing 44*b* abuts the outer surface of bushing 33. This configuration will allow the auger 44*a* and chisel housing 44*b* to efficiently engage and eject the chips or scrap removed from the workpiece through an opening, such as slot 44*d*, in the chisel housing 44*b*. The chisel housing 44*b* may be positioned so that the slot 44*d* is located in any direction scrap is preferred to be ejected (e.g., forward, backward or to either side). In addition, some chisel housings 44*b* may be provided with more than one opening, such as slots located on opposing sides of the chisel, so that more scrap may be removed or ejected if desired.

In yet other embodiments, the chisel positioning tool 72 may comprise a ball and detent system wherein one of the chisel and bushing define a detent and the other of the chisel and bushing have a spring biased ball for mating with the detent. In this manner, the chisel may be inserted into the bushing until the ball engages the detent indicating that a desired position has been reached wherein the chisel is spaced an appropriate amount for the bushing in order to insert the auger. Once the auger has been secured in the chuck, the chisel may be inserted further into the bushing so that the shoulder of the chisel abuts the outer surface of the bushing and the chisel can be secured into its final position before performing work on the workpiece. In a preferred form, the ball will engage a second detent when the chisel has reached its final position to further assist the operator in preparing the mortiser for operation. Additional balls or detents may be provided as desired, such as for example, in order to place chisels of different sizes.

In yet another embodiment, the chisel positioning tool 72 may comprise a rotatable bushing, wherein at least a portion of the bushing may be rotated into a first position in order to adjust the size of the bushing opening so that the chisel may only be inserted into an initial position in the bushing. After the chisel has been inserted to the initial position and secured, the auger may be inserted into the chuck and secured. Then, the bushing may be rotated to a second position where the chisel is allowed to be inserted into its final position in the bushing and secured.

A housing 36 containing the controls for the motor 30, is mounted in a convenient location on the power tool, such as for example adjacent the motor 30. In the embodiment illustrated, the control switch 38 is a paddle switch which pivots about its upper most point. To activate the mortiser, the lower portion of the switch 38 is pulled out away from the housing and to deactivate the mortiser, the lower portion of the switch 38 is pushed in toward the housing. This type of paddle switch is preferable in that inadvertently bumping the control switch 38 will cause the switch to turn off rather than on. To further reduce the risk of inadvertent operation, the control switch 38 may also be keyed. For example, in the embodiment illustrated, the control switch 38 has a removable key portion 38*a* which prevents the switch 38 from actuating the mortiser if the key 38*a* is not properly positioned thereon. Thus, when the mortiser is not in use, the operator may simply remove the key 38*a* to disable the switch 38, such as for example by disengaging the paddle switch from the contacts of the inner switch, to prevent the mortiser from being operated. To assist the user in removing the key 38*a*, the housing 36 has notches or grooves 36*a-b*, which allow the operator to reach around the sides of the actuator or control switch 38 and pull the key portion 38*a* out of switch 38.

As noted above, it is desirable in a mortiser to be able to vary the speed of the motor 30, depending on variables affecting the operation of the mortiser, for example, sharpness of the chisels, type of wood to be mortised, etc. Accordingly, to control the motor 30, the housing 36 is provided not only with an actuator or control switch 38, for turning the motor on and off, but additionally with a speed control, such as speed control knob 40, for a motor control circuit in the housing 36 in order to operate the motor 30 at a desired speed. The specific circuit controlled by the knob 40 may be any conventional motor speed control circuit, depending on the type of motor, which, preferably is a single-phase induction AC motor. An example of a speed control circuit that may be used for this purpose is discussed further below with respect to FIG. 6. In a preferred form, the motor 30 is a single-phase induction, ¾ HP, 115V AC motor with a speed variable between a range of about 1,725 RPM and about 3,450 RPM. However, other types of electric motors and motors of other types may conceivably be used, depending on the availability and specific application. For example, a DC motor may be used in place of an AC motor particularly in view of the relative ease in varying the speed of a DC motor.

Mounted near the upper end of the post 14 and extending in a rearward direction out of the path of travel of the carriage 18, is a tool caddy 42 for supporting a number of different chisel housings 44*b* and other tools so that they will be conveniently accessible for use when necessary. In the embodiment illustrated, the caddy 42 is designed to hold chisel housings 44*b*, chuck key 32*a*, chuck extension adaptor (not shown), pilots (not shown) and chisel bushings, preferably of ⅝", ¾", and 1⅛" sizes. The caddy 42 is mounted on the post 14 in a suitable manner, for example, by inserting the edge of the caddy into a slot formed in the surface of the post 14 and securing the caddy 42 to the post by fasteners, such as screws 46. The caddy 42 additionally is supported in a substantially horizontal position by a support, such as gusset member or bracket 42*a*, which is integral to the caddy 42 and extends from the bottom of the caddy 42 to the surface of the post 14.

Figure 2:
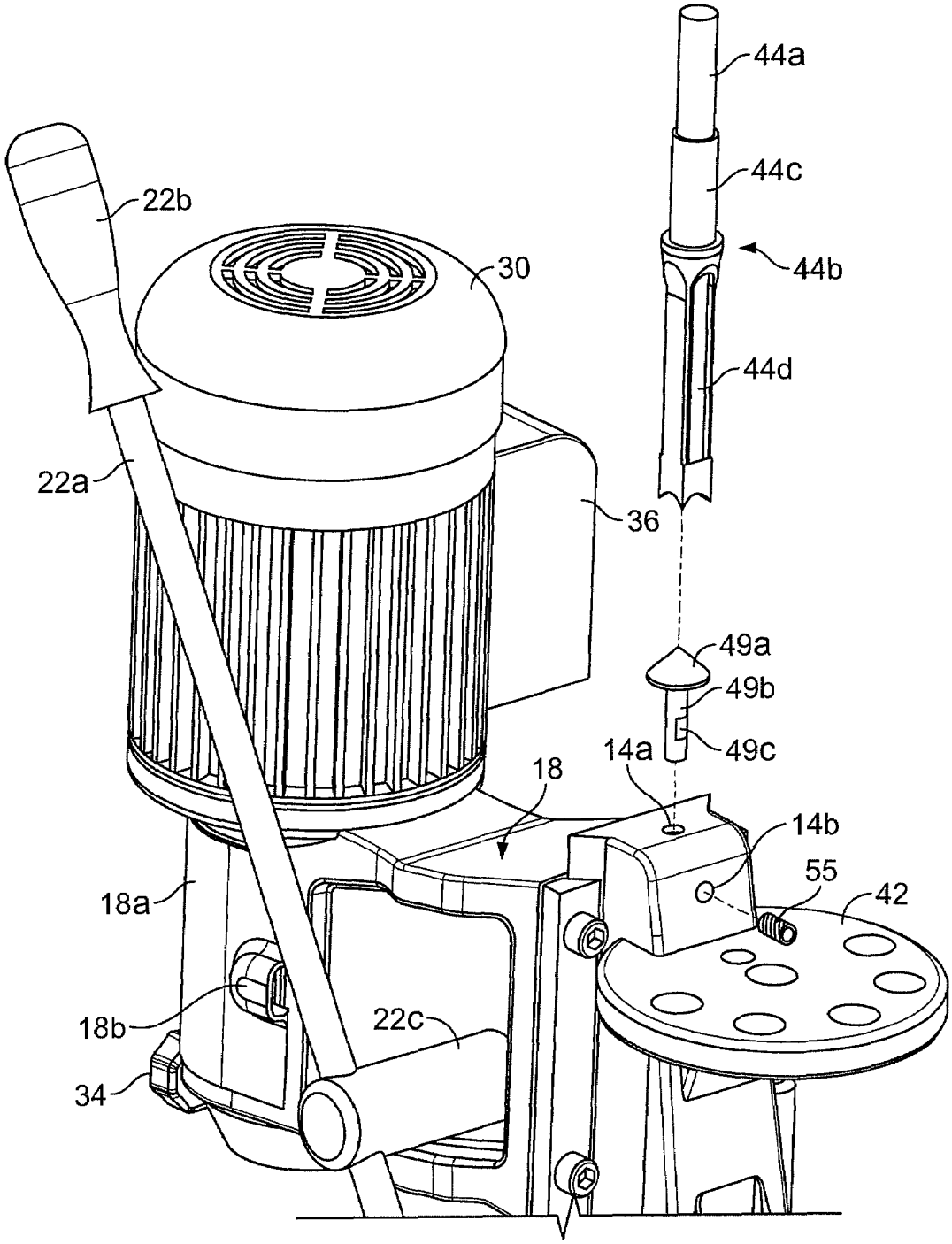
FIG. 2 is an enlarged partial perspective view of the mortiser of FIG. 1A showing a chisel and tool sharpening arrangement exploded from the tool caddy, but with the table and fence removed for clarity.

Although the caddy 42 is used for convenient storage of chisels and tools, and may on occasion even carry a sharpening tool, no provisions are made in the mortisers to date for enabling the sharpening of any tool directly on the mortiser. Accordingly, a feature of the present invention is a chisel sharpening tool 49 mounted at a convenient location on the mortiser itself, and preferably mounted on the post or tool support 14 as illustrated in FIG. 2. In this form, the integrated tool sharpening device 49 comprises a diamond cone sharpening tool that is removably mounted on the upper end surface of the post 14. The mounting may, for example, be via a bore or opening 14*a* formed or provided in the end surface of the post 14, into which a shaft 49*b* disposed on the rear surface of the cone 49*a* extends. To secure the shaft 49*b* in the bore 14*a* and prevent rotation of the tool or cone 49*a* during use, the shaft 49*b* is provided with a flat 49*c* which is engaged by a setscrew 55 threaded into a second bore 14*b* located in the side of the post 14.

In alternate embodiments, the shaft 49*b* and bore 14*a* may have corresponding shapes which prevent rotation of the cone 49 without the need for an additional fastener, such as setscrew 55. For example, the shaft 49*b* and bore 14*a* may have corresponding flat surfaces which prevent rotation of the shaft 49*b* in the bore 14*a*. It should also be noted that, although a simple cone shape sharpening tool has been shown, any of the well-known sharpening tools for such chisels may be attached to the mortiser at an applicable location. For example, in an alternate embodiment, the sharpening tool 49 may be a chisel cutter rather than a diamond cone. Furthermore, the sharpening center may include sharpening tools with differing characteristics to perform various roles with respect to sharpening the tool. For example, the sharpening system may include a first sharpening tool to perform coarse sharpening and a second sharpening tool to perform fine sharpening or honing of the tool. The first and second sharpening tools may both be removably mounted to the mortiser or, alternatively, have one mounted on the mortiser and the other mounted in the caddy possibly along with other sharpening tools. In this way, the integrated sharpening system may be used to perform multiple sharpening tasks or steps of sharpening as desired.

In yet other embodiments, the sharpening system may be located in different locations on the mortiser. For example, rather than mounting the sharpening tool at the top of post 14, it may be mounted at the rear end of the table 10 with a hold down mechanism, such as a plunger, located above to press the chisel onto the sharpening tool 49 while it is being sharpened to ensure a sharp edge. Alternatively, the sharpening tool may be provided in other positions, areas or zones of the mortiser, such as on top of the fence 52, which may be more suitable to perform different sharpening tasks.

The sharpening tool 49 may also be provided as an aftermarket attachment for existing mortisers. For example, the sharpening tool 49 may have a magnetic backing or an adhesive backing that allows the sharpening tool to be fastened or secured to an existing mortiser in any of the positions discussed above. Alternatively, the sharpening tool may be connected to a base or stand for use with a power tool, such as a mortiser. In addition, the sharpening tool 49 may be provided with a modular construction so that the sharpening tool itself may be replaced when desired. For example, the sharpening tool may have a base portion which can be fixed to a mortiser and a removable sharpening portion which can be removed from the base portion and replaced with an alternate sharpening portion. The alternate sharpening system may be designed to perform a different sharpening function than the sharpening portion it is replacing, or may simply be an identical type of sharpening system that is merely meant to replace the original sharpening system.

In addition to support 14, the mortiser may also have a fence 52 mounted on the upper table work surface 12, which is used to position a workpiece, such as wood, so that the chisel assembly 44 may be operated thereon. In the embodiment illustrated, the fence 52 has an L-shaped construction with a generally flat base or support plate 52*a* and a wall 52*b* extending upward therefrom. The base 52 rests on the surface 12 and extends from the upstanding wall 52*b* toward the post 14. Together, the base 52*a* and upstanding wall 52*b* form a generally flat forward surface that is perpendicular to the upper table work surface 12. In the embodiment illustrated, an opening 53 is provided in the middle of the upstanding wall 52*b* to provide clearance for hold down clamp 54. For strength, the ends of the fence wall 52*b* are connected to the base 52*a* via supports such as gusset wall members 52*c*.

Figure 3A:
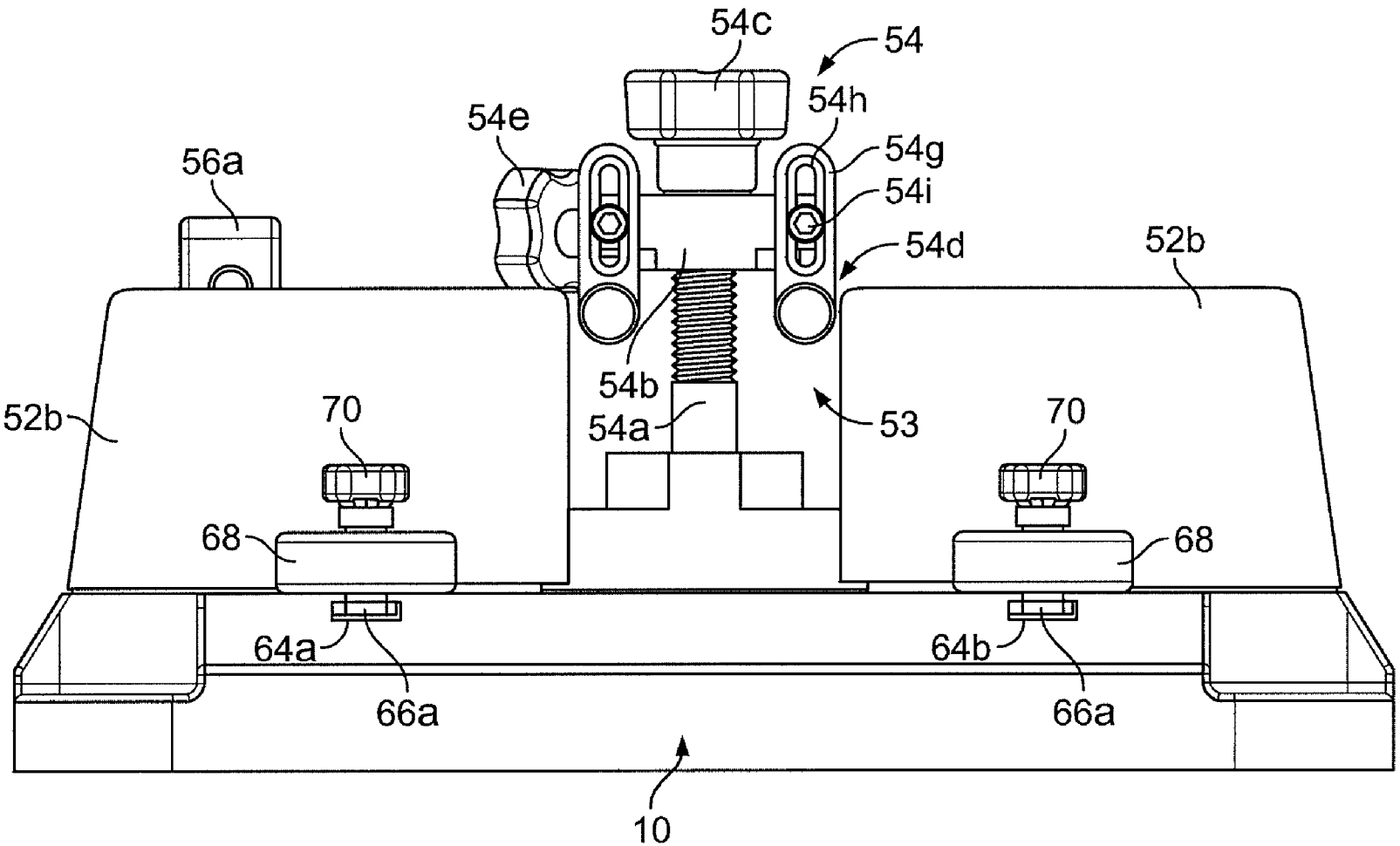
FIG. 3A is an enlarged front elevational view of the mortiser of FIG. 1A showing a table, fence and clamp in accordance with the invention, but with the support post for the motor and parts mounted thereon removed for clarity.
Figure 3B:
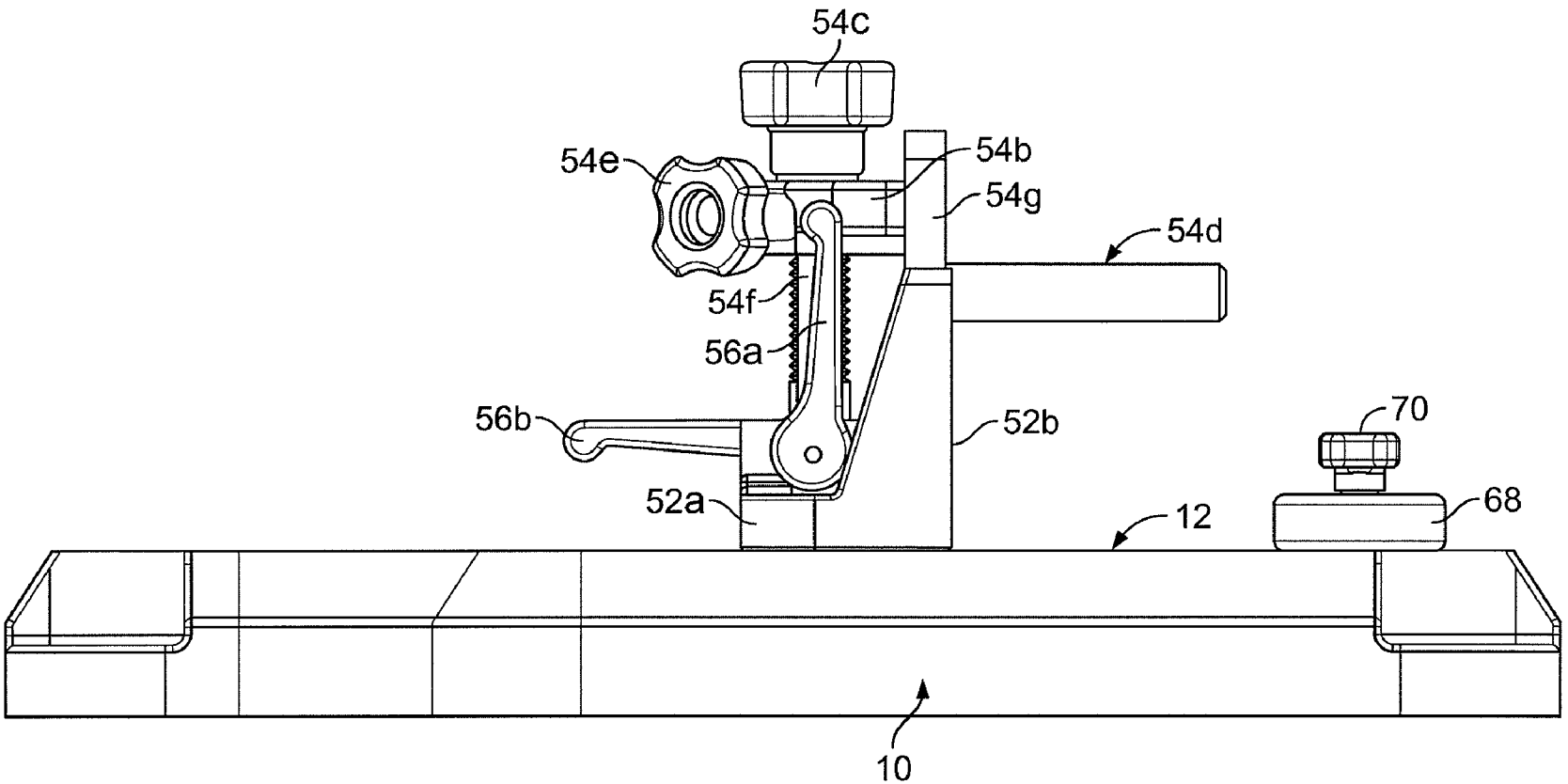
FIG. 3B is an enlarged side elevational view of the mortiser of FIG. 3A.
Figure 3C:
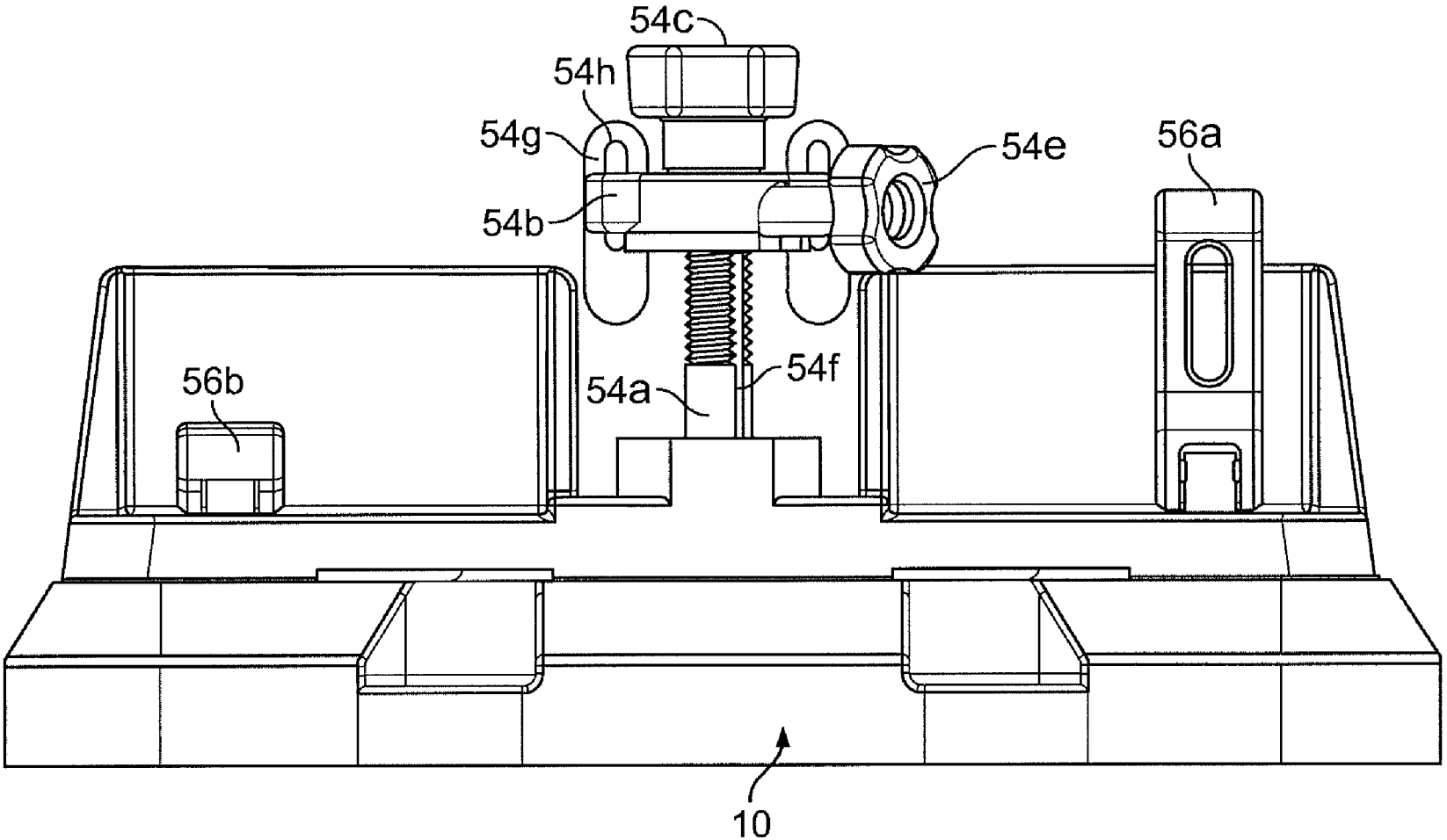
FIG. 3C is an enlarged rear elevational view of the mortiser of FIG. 3A.
Figure 3D:
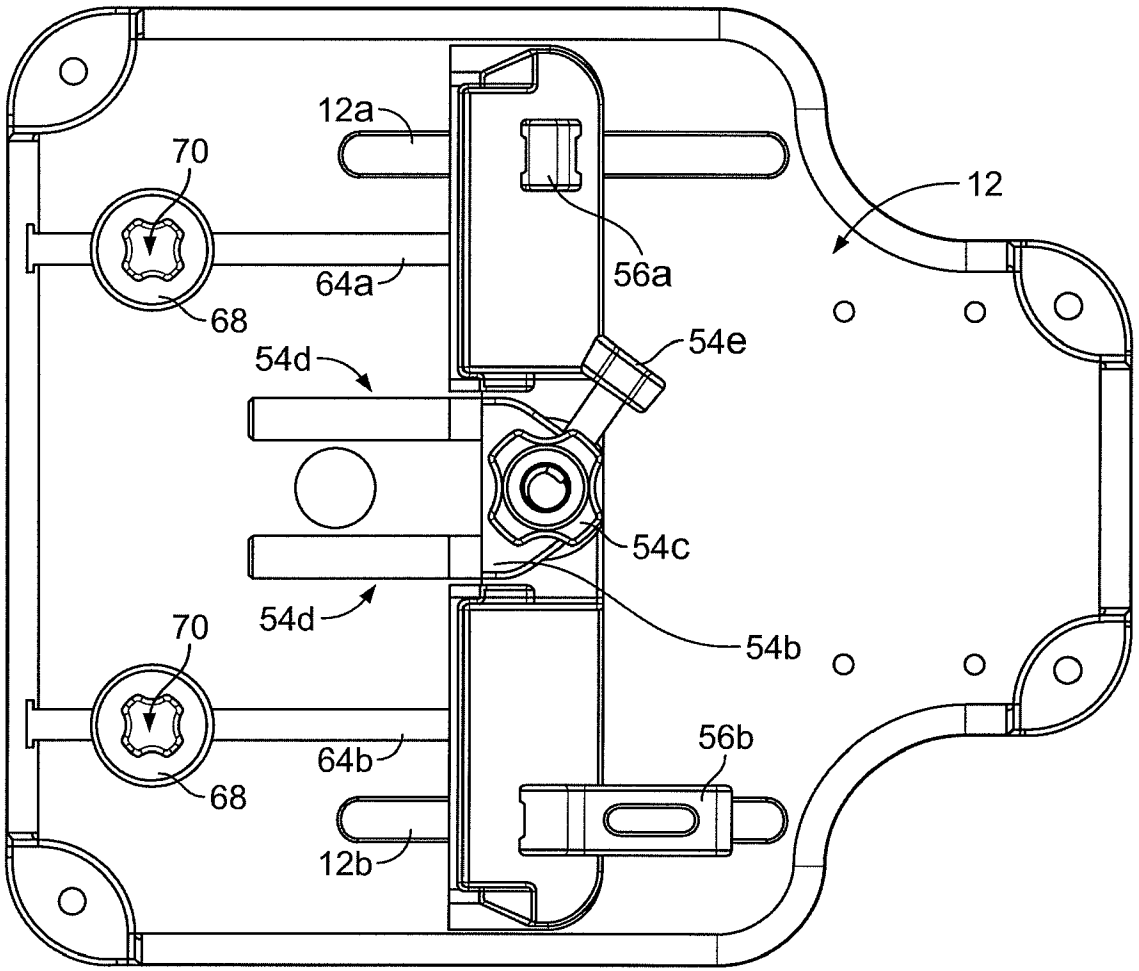
FIG. 3D is an enlarged top plan view of the mortiser of FIG. 3A.
Figure 3E:
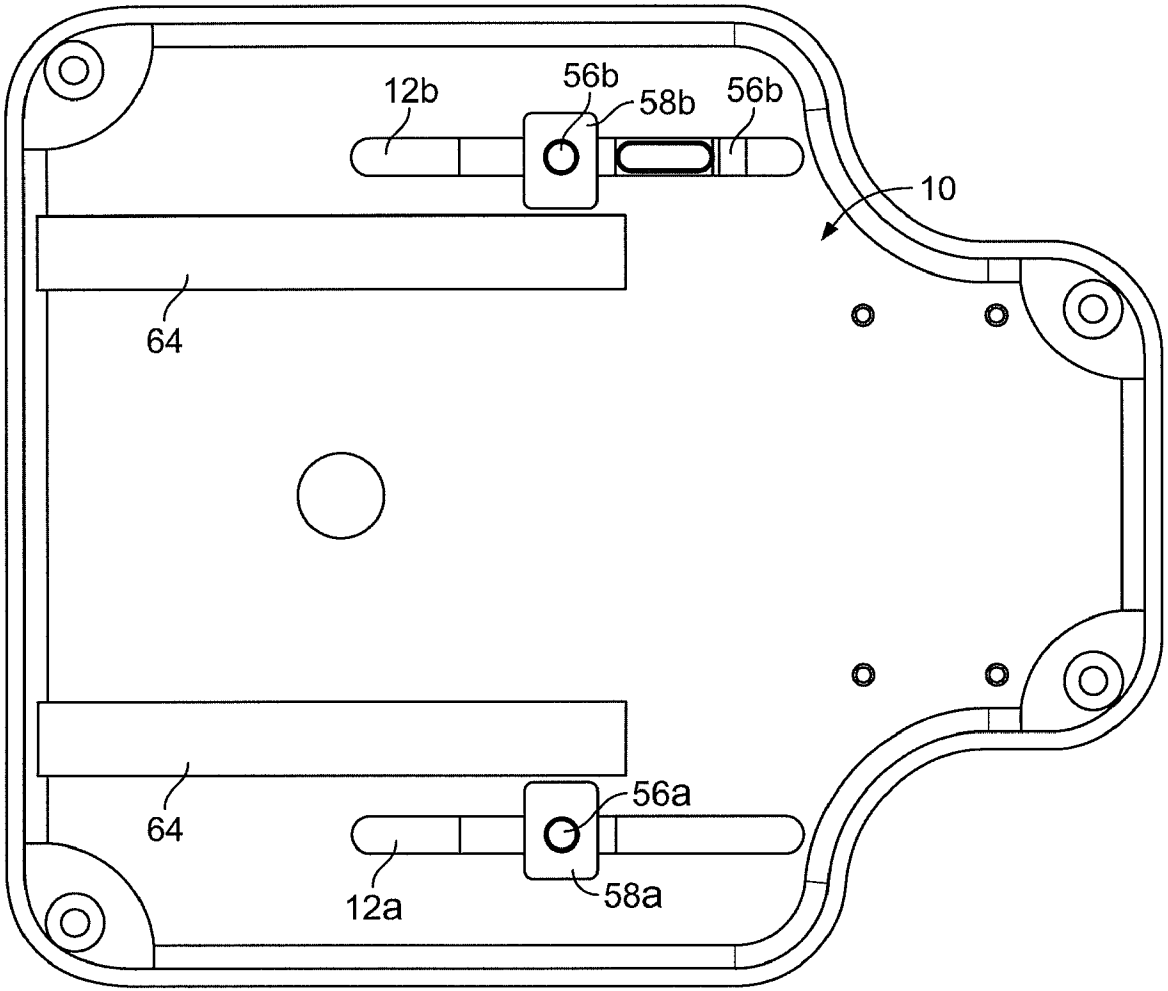
FIG. 3E is a bottom plan view of the mortiser of FIG. 3A.

The fence 52 is mounted on the surface 12 of the table for movement relative to the post 14. In the illustrated embodiment, the fence 52 is mounted for linear movement towards and away from the post 14. To facilitate such movement, the surface 12 is provided with two elongated parallel slots 12*a* and 12*b*, which are symmetrically disposed with regard to the post 14 and the carriage 18, and the fence 52 is provided with a pair of fasteners, such as cam-type clamps 56*a* and 56*b*, for securing the fence 52 into a desired position. The clamps 56*a* and 56*b* have portions that extend through respective openings in the fence base 52*a* and slots 12*a* or 12*b*, which are connected to bodies, such as nuts 58*a* and 58*b* having widths greater than the width of the slots 12*a-b* (see FIG. 3E). Consequently, when the clamps 56*a-b* are engaged by rotating or pivoting the clamp handles downward toward surface 12 causing the cammed surfaces to raise the shafts and nuts 58*a-b* attached thereto, the nuts 58*a-b* will grip the bottom of the table (e.g., the surface opposite surface 12), to maintain the fence 52 at the selected position. Conversely, when the handles of clamps 56*a-b* are lifted up, the shafts move nuts 58*a-b* away from the bottom of the table to remove the frictional engagement between the nuts 58*a-b* and the table 10 and allow the fence 52 to be moved or positioned about the upper surface 12. In the embodiment illustrated, the cam clamps 56*a-b* are high pressure toggle clamps, with one clamp, 56*a*, being shown in its release position and the other clamp, 56*b*, being shown in its locked or securing position. The handles of clamps 56*a-b* are pivotally connected to shafts which are threaded into nuts 58*a-b*. Thus, the handles of clamps 56*a-b* may be rotated to tighten or loosen the handle and shaft with respect to the nut, thereby increasing or reducing the frictional engagement created by the clamp when in its securing position. It should be understood, however, that in alternate embodiments, the handle may operate like a nut with a pivoting handle with the threaded shaft of a bolt extending up through the slots 12*a-b* and respective openings in the fence base 52*a* if so desired.

To actually position the fence 52 on the surface 12 prior to engagement of the clamps 56*a-b*, the rear edge surface of the base 52*a* is connected to another drive mechanism, such as rack 60, which is positioned parallel to surface 12 and preferably rests thereon. The rack 60 extends from the support 52*a* perpendicular to the front surface of the fence 52 towards the post 14, where it passes through the post 14 and is engaged therein by a pinion gear (not shown). Control of the pinion gear is carried out via an actuator such as handle or knob 62 which is connected to the pinion gear via an attached shaft. Thus, when the handle 62 is rotated in a first direction, the pinion gear drives the rack in a first direction causing the fence to be moved in the direction of travel of the rack. Conversely, when the handle 62 is rotated in the opposite direction, the pinion gear drives the rack in an opposite or second direction with the fence continuing to be moved in the direction of travel of the rack.

In a preferred embodiment, handle 62 is mounted at a forty-five degree angle with respect to post 14 so that it is easier for an operator to use when standing in front of the mortiser and not obstructed by the fence 52. In alternate embodiments, however, handle 62 may extend out perpendicular to the post 14 if desired. In addition, the handle 62 may be formed similar to lever 22 in that it may be fitted onto the gear drive shaft like a socket and capable of being connected to the drive shaft on either side of post 14. In yet other embodiments, the handles of the mortiser, including handle 62, may include a clutched handle capable of shifting between an engaged position wherein the handle engages and drives a driven member, such as the axial pinion gear shaft, and a disengaged position wherein the handle disengages from the driven member and is freely positionable in both a clockwise and counterclockwise direction with respect to the driven member. Such a handle may be biased in the engaged position via a biasing mechanism, such as a spring, and may be pulled out from the power tool to compress the spring and disengage the handle from the driven member so that the handle may be repositioned with respect to the power tool and the driven member. Such a handle is disclosed in U.S. Patent Application No. 2004/0070132 A1, which was published on Apr. 15, 2004, and is hereby incorporated herein by reference in its entirety.

In a preferred form, the mortiser will have a fence adjusting handle 62 extending from both sides of the post 14 in order to accommodate operators that prefer to use their left hand and those that prefer to use their right hand when adjusting the fence position. For example, a first handle may extend from a first side of the support 14 and a second handle may extend from a second, preferably opposite, side of the support 14, with the handles being connected to a common drive mechanism, such as rack 60, for moving the fence 52 toward and away from the support 14.

In order to secure or clamp the workpiece on the table surface 12 in a horizontal direction against the fence 52, table surface 12 is provided with a further pair of slots or grooves, such as inverted T-slots 64*a-b*, which extend parallel to the slots 12*a-b*, and which are open at their upper end. To provide the actual holding of the workpiece, the enlarged head 66*a* of a fastener, such as a bolt 66, is inserted into the T-shaped slot 64*a* or 64*b*, so that a stop, such as roller stop 68, may be mounted on the portion of the bolt 66 extending above surface 12 by a fastener, such as a nut 70. The roller stop 68 rests on surface 12 and may be secured at a desired position along the slots 64*a-b* by simply tightening the nut 70. Once tightened, the roller stop 68 will be prohibited from moving back and forth along the slot 64*a* or 64*b*, but will be allowed to rotate about an axis defined by the bolt 66. With this arrangement, tightening of the nut 70 will secure the roller stop 68 in a desired horizontal position along the table surface 12, with a workpiece being disposed between the stops 68 and the fence 52, but allow the user to slide the workpiece along the fence 52 so that multiple mortises may be made in a single workpiece without the need to move either the fence 52 or the stops 68. In the embodiment illustrated, the nut 70 is in the form of a plastic handle or cap with a threaded insert for receiving the distal end of bolt 66 and the roller stop 68 is in the form of a plastic hub having a rubber sleeve extending around its outer annular surface. In a preferred form, the roller stops 68 may further incorporate ball bearings to reduce friction between the stops 68, fence 52 and workpiece so that the operator may slide the workpiece along the fence 52 more easily. It should be understood, however, that in alternate embodiments other types of stops, such as rubber blocks, may be used in place of roller stops particularly if the ability to slide the workpiece along surface 12 is not desired.

A clamping arrangement, such as hold down clamp 54, is also provided to secure or clamp a workpiece against the surface 12 in a vertical direction so that the workpiece does not get stuck on the chisel housing 44*b* when the carriage 18 is raised and lowered via lever 22. In the form illustrated, the clamping arrangement generally includes a bolt 54*a* extending upward from the surface of the fence base 52*a* and extending perpendicular to the surface 12. The bolt 54*a* is preferably centrally located about the fence and aligned with the opening 53 located between the upstanding wall members 52*b*. To do the actual securing, a body 54*b* is provided with a bore through which the bolt 54*a* extends, and a second body, such as nut 54*c*, is fastened to the free end of the bolt 54*a*. The body 54*b* may be provided with one or more arms 54*d* that extend from the body 54*b* generally parallel to the surface 12 and extend towards and perpendicular to the surface of the fence 52. Arms 54*d* are of a length so that they extend beyond the fence 52, and thus over the area where a workpiece would be positioned against the fence 52.

The notch or opening 53 in fence 52 enables the arms 54*d* to extend down to the work table surface 12 and thus enable the clamping of relatively thin workpieces relative to the height of the fence 52. More particularly, this configuration allows the arms 54*d* to extend through the opening 53 when body 54*b* is lowered beyond the upper surface of the fence 52. In a preferred form, the opening 53 extends completely through the fence 52 and extends from an upper end surface to a lower end surface of wall 52*b*, thus separating the fence wall 52*b* into essentially two spaced wall portions. However, it is understood that a lesser depth extending downwardly from the upper edge of fence 52 can be provided if desired.

The body 54*b* may be secured about the bolt 54*a* in a desired vertical position by tightening a fastener, such as setscrew 54*e*, to lock the body 54*b* in position. In the form illustrated, the setscrew 54*e* is thread through a bore in body 54*b* and engages a longitudinally extending flat 54*f* (FIGS. 1C and 4C) located on the surface of the bolt 54*a*. Thus, the setscrew 54*e* may be used to position the clamp 54 in a temporary position while a workpiece is inserted between the fence 52 and stops 68 and below the arms 54*d*. Once the workpiece has been loaded, the fence 52 and stops 68 may be used to secure the workpiece in a horizontal direction in the manner discussed above, and the setscrew 54*a* may be loosened to allow the body 54*b* to be lowered until the arms 54*d* are positioned on an upper surface of the workpiece. The nut 54*c* can then be rotated into engagement with the body 54*b* to fix the arms 54*d* against the upper surface of the workpiece, thereby securing the workpiece in the vertical direction. In alternate embodiments, the nut 54*c* may be connected to the body 54*b* so that a separate fastener, such as setscrew 54*e*, is not needed. For example, nut 54*c* may be connected to body 54*b* so that the body is driven up and down the bolt 54*a* via rotation of the nut 54*c* in a clockwise and counter clockwise manner. With this configuration, a separate fastener is not needed to lock the body 54*b* in a desired position along bolt 54*a* because the nut that is used to drive the body 54*b* into the desired position along bolt 54*a* also retains the body 54*b* in this position.

With respect to the appendages 54*d* of clamp 54, it should be understood that the arms may be either fixed or movable and extend from the body 54*b* in any manner so that they pass through the opening 53. In a preferred form, arms 54*d* are adjustable as illustrated in FIGS. 4A-D and extend perpendicular to the front surface of the fence. More particularly, arms 54*d* are provided with an extension 54*g* making the arms essentially L-shaped as shown. The extensions 54*b* define elongated slots 54*h*, and are connected to the body 54*b* via a fastener, such as bolt 54*i*, which extends through the slot 54*h* into the body 54*b*, so that the arm 54*d* is mounted for rotation about the axis of the bolt 54*i*, which is parallel to the surface 12. In the embodiment illustrated, each slot 54*h* has an internal shoulder separating the slot into a first bore that is wider and longer than the second bore. In this manner, the bolt 54*i* may be recessed or countersunk into the first bore portion of slot 54*h* so that the head of the bolt 54*i* engages the internal shoulder of the slot to secure the arm 54*d* in position without creating a protrusion extending out from the outer surface of the extension 54*g* and beyond the plane of the fence.

Since the slot 54*h* extends transverse to the axis of bolt 54*i*, the location of the axis relative to the length of the extension 54*g* can be varied. With this arrangement, not only may the vertical position of the arm portion 86 be varied by vertical movement of the body 54*b* along the bolt 54*a* or by the downward or upward position of the bolt 54*i* along the slot 54*h*, but moreover the arms 54*d* may be rotated about the axis of their respective bolts 54*i* so that the arms 54*d* are above and over the top edge of the fence 52, and this rotation may be made independent of one another. In general, the arms 54*d* can be rotated about the axis of bolts 54*i* to any desired position (e.g., closer together, farther apart, etc.) Thus, even workpieces of a thickness or height greater than the height of the fence 52 may be easily clamped, as well as odd-shaped pieces may be clamped simply by adjusting the positions of the two arms 54*d* to whatever position is required in order to clamp the odd-shaped piece. In fact, when the arms 54*d* are positioned above the fence 52, the outer surface of the arm extensions 54*g* remain coplanar with the outer surface of the fence 52 and effectively serve as an extension of the fence 52.

Figure 4A:
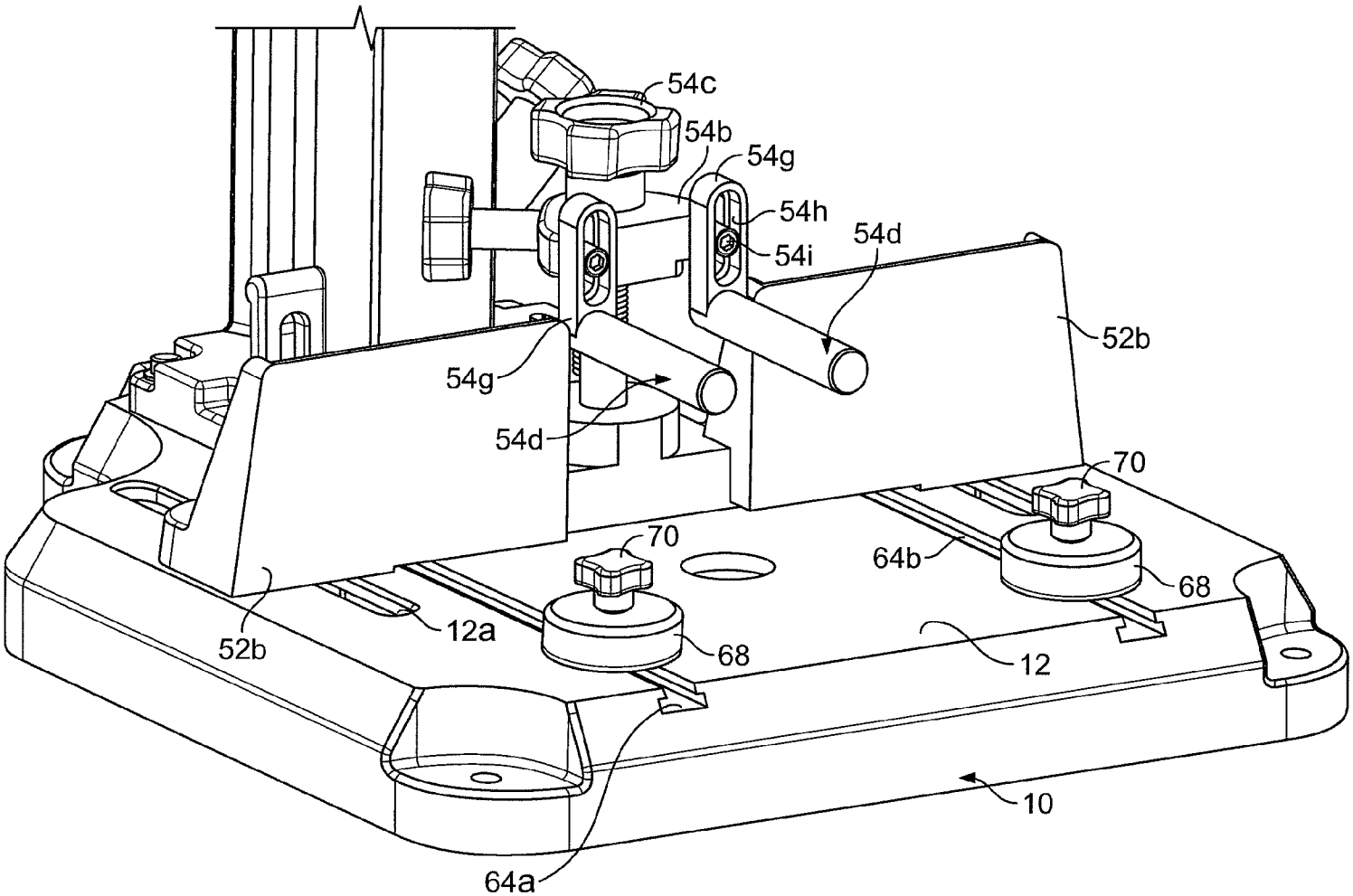
FIG. 4A is an enlarged perspective view of the mortiser of FIG. 1A showing the arms of the clamp in a first position.
Figure 4B:
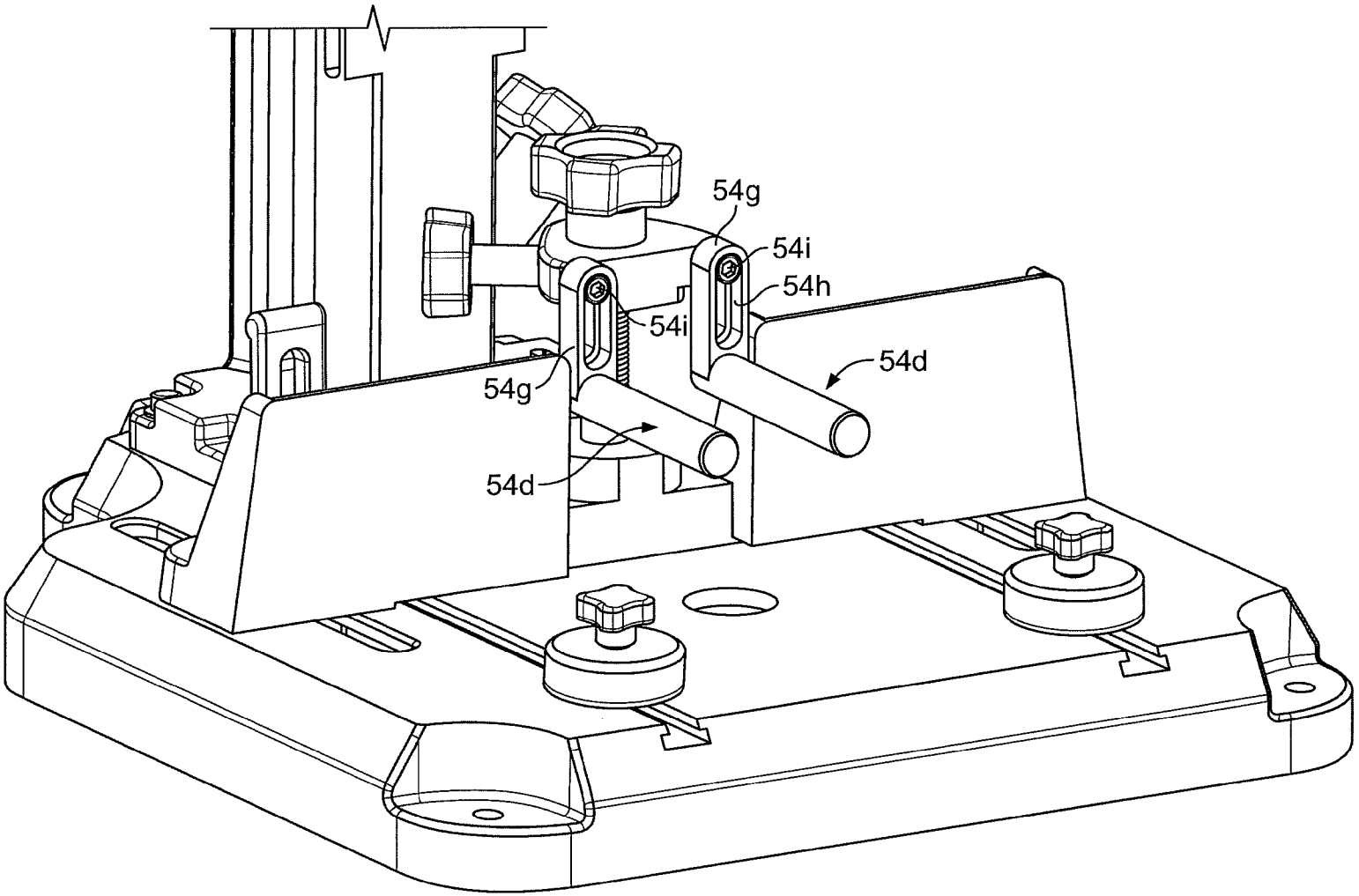
FIG. 4B is an enlarged perspective view of the mortiser of FIG. 1A showing the arms of the clamp in a second position.
Figure 4C:
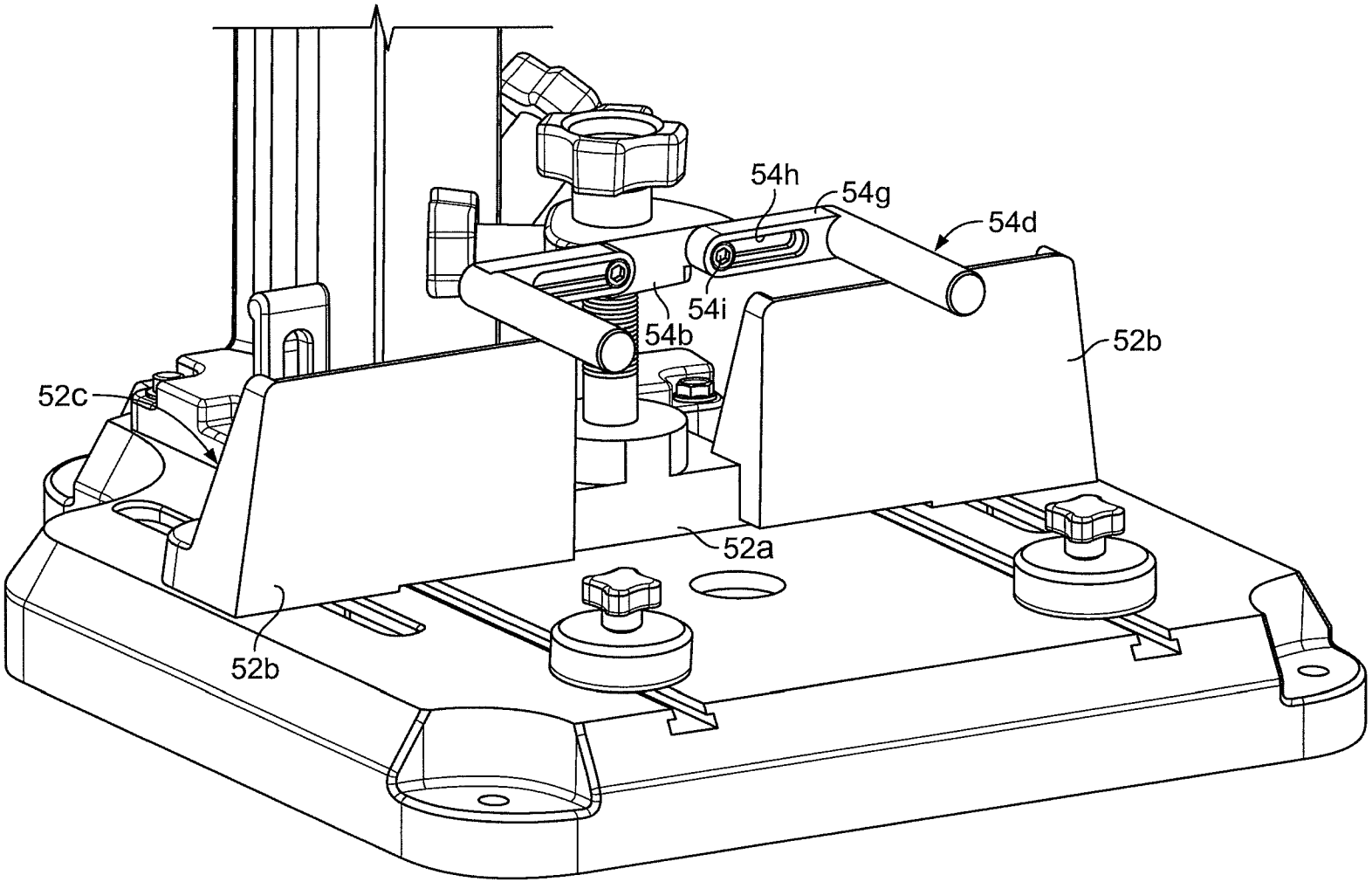
FIG. 4C is an enlarged perspective view of the mortiser of FIG. 1A showing the arms of the clamp in a third position.
Figure 4D:
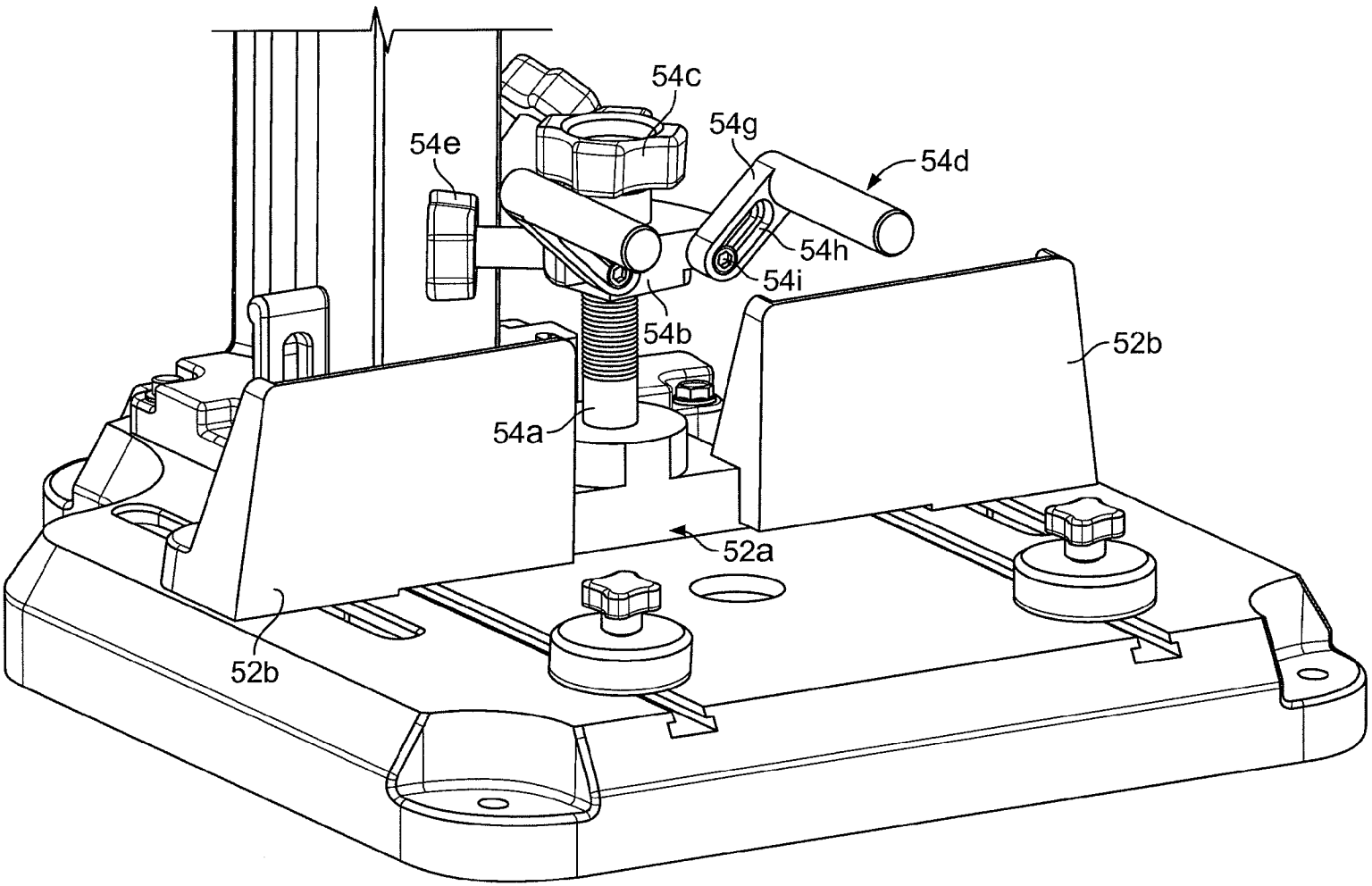
FIG. 4D is an enlarged perspective view of the mortiser of FIG. 1A showing the arms of the clamp in a fourth position.

Some of the many positions the clamp 54 may be placed in are illustrated in FIGS. 4A-D. For example, in FIG. 4A, the bolts 54*i* fasten the extensions 54*g* at an intermediate position along the slots 54*h* with the slots in a vertical orientation allowing the arms 54*d* to extend down and through opening 53. In FIG. 4B, the bolts 54*i* fasten the extensions 54*g* at the end of slots 54*h* with the slots in a vertical orientation so that the arms 54*d* may extend down and through opening 53 to reach their lowermost depth (e.g., for clamping very small workpieces). In FIG. 4C, the bolts 54*i* fasten the extensions 54*g* at the end of the slots 54*h* with the slots in a horizontal orientation so that the arms 54*d* may extend above the fence 52 and far apart from one another. In FIG. 4D, the bolts 54*i* fasten the extensions 54*g* at the end of the slots 54*h* with the slots in an angled orientation so that the arms 54*d* may extend further above the fence 52. It should be understood, however, that the extensions 54*g* and arms 54*d* may be placed in a variety of other positions in order to accommodate different workpieces. For example, some workpieces may require the arms 54*d* to be positioned at different heights and/or positions (e.g., asymmetrical) in order to secure the workpiece in a vertical direction.

In an alternate embodiment, the appendages 54*d* may be fixed arms extending from the body 54*b* and perpendicular to the front surface of the fence 52 so that they pass through the opening 53. For example, the arms may be cast as an integral piece of body 54*b* and may extend out from the body 54*b* so that the arms are generally parallel to surface 12. In a preferred form, a portion of the arms will extend downward from the body and in front of the fence 52 before extending parallel to surface 12 so that the hold down clamp 54 may be used to secure smaller workpieces as discussed above. In yet other embodiments, the appendages 54*d* may have different shapes. For example, the arms 54*d* may be flat L-shaped bars rather than a combination of a flat extension and a round bar as illustrated. Ideally, the power tool will be provided with one clamping mechanism 54 that may be used with other optional items, such as the movable arms and different shaped arms discussed above, so that the operator may customize the clamping mechanism to his or her particular application.

Regardless of the exact configuration, clamping mechanism 54 may be used to either "hard" clamp a workpiece in situations where the operator does not desire the workpiece to move at all, or simply provide an upper boundary in situations where the operator wishes to be able to slide the workpiece but prevent it from lifting up off of the table surface 12. If the latter is preferred, arms 54*d* of clamp 54 may also be formed as rollers connected to the body 54*b* to assist the operator in being able to slide the workpiece between the clamp 54, upper surface 12 and roller stops 68. For example, the horizontal portion of arms 54*d* may be rotatable with respect to extensions 54*g* so that the horizontal portion of the arms 54*d* rotate when a workpiece is being moved laterally thereto. Although the clamping mechanism 54 is illustrated in conjunction with a mortiser, it should be understood that such a clamping mechanism may be used in conjunction with a variety of other power tools, such as drill presses, band saws, miter saws, table saws and shapers, as well as on its own as a separate clamping fixture for use on bench tops or the like.

Figure 6A:
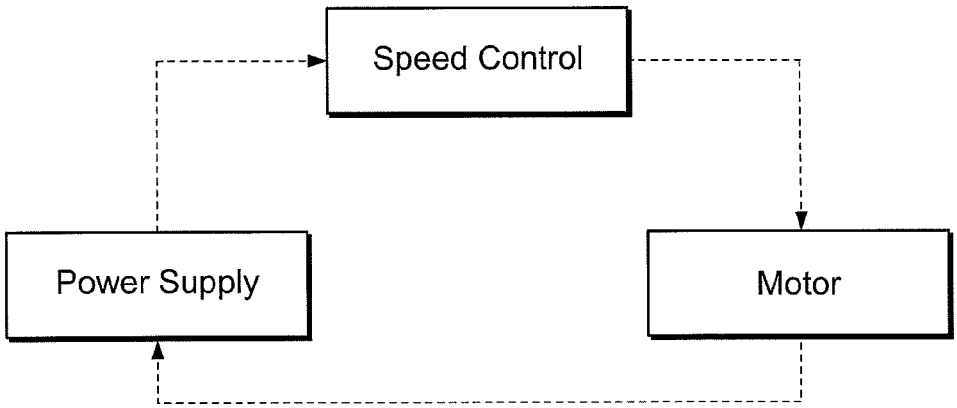
FIG. 6 is a schematic diagram of a motor control arrangement for the motor of the mortiser according to a feature of the invention.
Figure 6B:
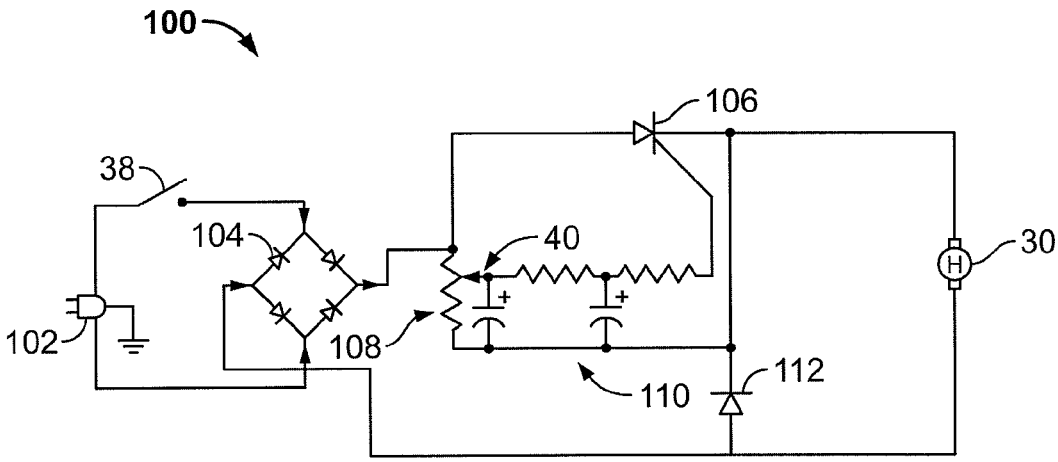

Turning now to FIGS. 6A-B, there are shown speed controls which may be utilized to control the speed of the mortiser. As shown in FIG. 6B, the circuit 100 generally includes a connector, such as plug 102, for connecting the circuit 100 to a voltage source, such as for example, a standard AC outlet. The circuit further includes a full wave bridge rectifier 104 which is connected across the power line via a switch, such as control switch 38 provided on housing 36 (FIG. 1A), which is in turn attached to the motor 30. The DC output terminals of the bridge rectifier 104 are connected across the motor 30, with one of the outputs of the bridge rectifier being fed to the motor 30 via a silicon-controlled rectifier (SCR) 106. A portion of the output current of the bridge rectifier 104 is also fed through a variable resistor 108 and an RC network 110 to the control electrode of the SCR 104 to control the gating thereof. A diode 112 is connected in the circuit to protect the circuit against inverse voltage spikes. By varying the position of the center tap of the variable resistor 108, which center tap is connected to the speed control knob 40 (FIG. 1A), the voltage supplied to the motor, and thus the speed of the motor 30, can be varied.

Figure 7:
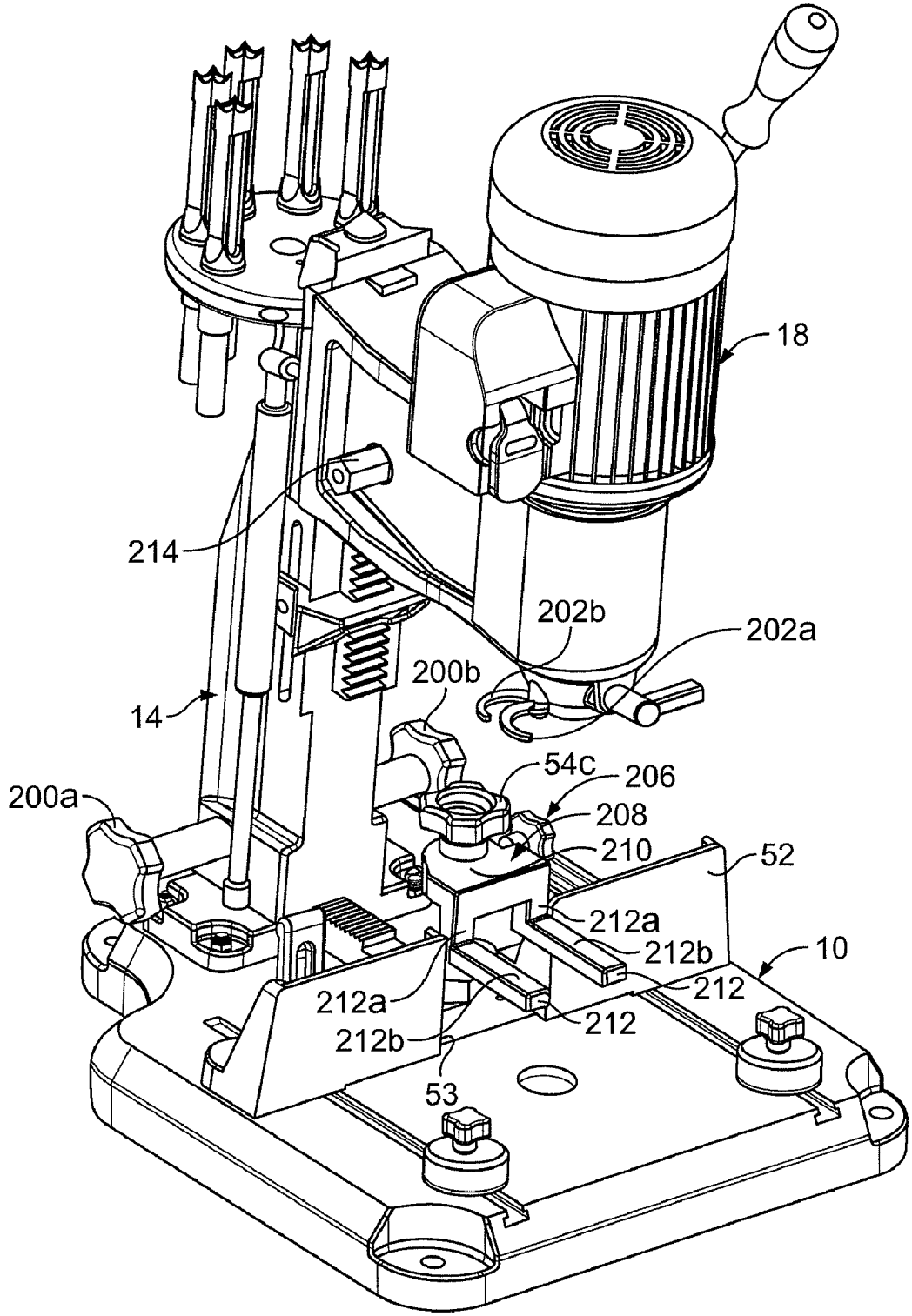
FIG. 7 is a perspective view of a mortiser according to the invention illustrating an alternate actuator for adjusting the fence, chisel positioning tool, and clamp.

It should be appreciated that the embodiments thus far disclosed are mere examples of the various features of the present invention and are not intended to limit the scope of the present invention. For example, it should be appreciated that while the mortiser 10 has been depicted in FIGS. 1A-1C as including a single handle or knob 62 for adjusting the location of the fence 52 along the rack 60, an alternative embodiment may include a fence adjusting handle extending from both sides of the post 14 to accommodate the different preferences of different operators, as mentioned above. FIG. 7 depicts such an alternative embodiment including a first handle 200*a* and a second handle 200*b*, either or both of which may be rotated to adjust the position of the fence 52. The first handle 200*a* extends from the left-hand side of the post 14 and enables a left-handed operator to comfortably adjust the location of the fence 52. The second handle 200*b* extends from the right-hand side of the post 14 and enables a right-handed operator to comfortably adjust the location of the fence 52.

Additionally, it should be appreciated that while the handle 62 in FIGS. 1A-1C is depicted as extending at an angle of approximately 45 degrees relative to the post 14, in alternative embodiments the handle 62 may extend out from the post at a variety of different angles. For example, the handles 200*a* and 200*b* of FIGS. 7 and 8, extend out perpendicular to the post 14, as mentioned above and depicted in FIG. 7. In yet other embodiments, the handle 62 or handles 200*a* and 200*b* may extend out from the post 14 at angles other than 45 or 90 degrees.

Furthermore, it should be appreciated that while the integrated chisel offset tool has thus far been described as including the spacer 72 depicted in FIGS. 5B and 5C, it may take any shape and provide any desired amount of spacing for a particular application, as mentioned above. For example, FIG. 7 depicts an integrated chisel offset tool including a first arcuate spacer 202*a* and a second arcuate spacer 202*b*. The first and second arcuate spacers 202*a* and 202*b* are pivotally mounted to the carriage 18 at a common location and secured thereto by a fastener that may or may not be removable such as a threaded bolt, screw, pin or rivet. In a preferred form, the first and second spacers 202*a* and 202*b* are pivotable independent of one another. In the embodiment illustrated, the first arcuate spacer 202*a* is disposed above the second arcuate spacer 202*b*. Similar to the spacer 72 discussed above with reference to FIGS. 5B and 5C, the first and second arcuate spacers 202*a*, 202*b* are provided to assist the operator in positioning an auger 44*a* and chisel housing 44*b* correctly with respect to the chuck 32 and bushing 33.

During installation of the auger 44*a* and chisel housing 44*b* and depending on the particular application involved, either the first arcuate spacer 202*a* or both the first and second arcuate spacers 202*a* and 202*b* are utilized. After partially inserting the auger 44*a* into the bushing 33, an operator pivots the desired arcuate spacer(s) 202*a*, 202*b* from a first position or stored position (shown in FIG. 7) to a second position or used position (not shown) in alignment with the opening of the chuck and/or in engagement with the chisel housing 44*b* to space the shoulder of the chisel sleeve 44*c* from the bottom of the bushing 33. The arcuate spacer(s) 202*a*, 202*b* engage the chisel housing 44*b* in a manner similar to that which the spacer 72 engages the chisel housing 44*b* depicted in FIG. 5B. Once the chisel housing 44*b* is secured into the bushing 33 with the chisel lock 34, as discussed above, the operator pivots the arcuate finger(s) 202*a*, 202*b* back to their first positions or stored positions (shown in FIG. 7) so that the mortiser may be prepared for use.

In one embodiment a thickness of the first arcuate spacer 202*a* is substantially equal to a thickness of the second arcuate spacer 202*b*. In an alternative embodiment, one of the first and second arcuate spacers 202*a*, 202*b* is thicker than the other. For example, similar to that described above with reference to the spacer 72, the first arcuate spacer 202*a* may be 3 mm thick and the second arcuate spacer 202*b* may be 1 mm thick. Therefore, depending on the specific application involved, an operator may select a 3 mm or a 4 mm spacer. It should be appreciated, however, that the arcuate spacers 202*a*, 202*b* may be any desired thickness and they are not limited to the thicknesses described herein. Nevertheless, in the embodiment illustrated in FIGS. 7 and 8, a larger spacer is provided when both the first and second arcuate spacers 202*a* and 202*b* are pivoted into engagement with the chisel housing 44*b* than when just the first arcuate spacer 202*a* is pivoted into engagement with the sleeve 44*c*.

In yet other embodiments, the lower second spacer 202*b* may be designed such that the operator need only pivot this spacer into alignment with the chuck opening and/or in engagement with the chisel housing 44*b* in order to space the shoulder of the chisel sleeve 44*c* the appropriate amount of distance from the bottom of the bushing 33. This, in such a configuration, the operator need not pivot both spacers 202*a* and 202*b* into alignment with the chuck opening in order to provide an accurate amount of spacing, but rather, can rely on the distance the spacer is disposed from the chuck opening or bottom of the bushing 33 in order to ensure the proper spacing for the chisel housing 44*b*. Thus, in alternate embodiments, the size of the spacer need not be of concern, but rather, the spacer's location with respect to the chuck opening and/or the bushing 33 may be used to ensure the proper spacing. Additionally, it should be appreciated that while a mortiser having two arcuate spacers 202*a*, 202*b* has been described herein, an alternative embodiment may include any number of arcuate spacers. Furthermore, while the arcuate spacers 202*a*, 202*b* have been disclosed herein as specifically being arcuate, it is foreseeable that they may be provided in a number of different shapes and sizes such as, for example, straight, V-shaped or other shapes capable of serving the intended purpose.

Figure 8:
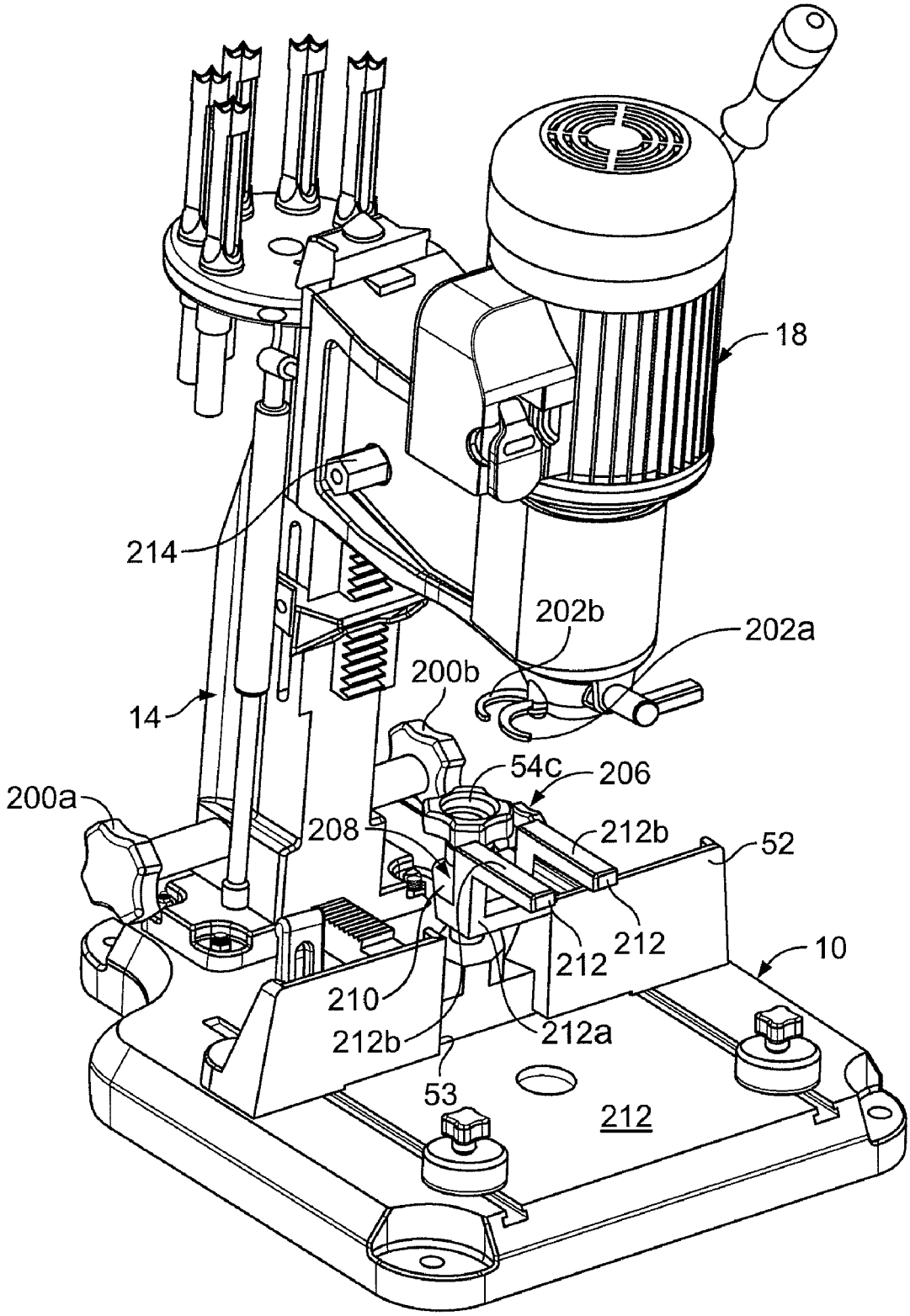
FIG. 8 is a perspective view of the mortiser of FIG. 7 illustrating the clamp in an alternate configuration.

While the hold down clamp 54 has been described herein as including appendages comprising adjustable arms 54*d* extending from the body 54*b*, in alternate embodiments the hold down clamp may alternatively include fixed appendages extending from the body, as mentioned above. For example, FIGS. 7 and 8 depict an alternative hold down clamp 206 including a body 208 disposed on the bolt 54*a* (shown in FIG. 3A). Similar to the hold down clamp 54 described above, the body 208 is vertically adjustable on the bolt 54*a* and selectively restrained by the nut 54*c*. The body 208 includes a support portion 210 and appendage portions 212. The body 208, for example, may be formed of cast iron, forged steel, aluminum or some other rigid material. The support portion 210 includes a central bore receiving the bolt 54*a*. Each of the appendage portions 212 include an extension portion 212*a* and an arm portion 212*b* forming an L-shape. In FIG. 7, the extension portions 212*a* extend generally perpendicularly downward from the support portion 210 of the body 208. The arm portions 212*b* extend generally perpendicularly from the extension portions 212*a* and through the opening 53 in the fence 52. Due to the downward offset configuration of the arm portions 212*b* relative to the support portion 210 in FIG. 7, the arm portions 212*b* are capable of securingly engaging workpieces having relatively small vertical dimensions. Alternatively, however, the body 208 of the hold down clamp 206 may be inverted or turned upside down, as shown in FIG. 8, such that the arm portions 212*b* are upwardly offset relative to the support portion 210. This upward offset configuration of the arm portions 212*b* relative to the support portion 210 enables the hold down clamp 206 to accommodate workpieces having relatively large vertical dimensions.

Still further, while it was mentioned above that the lever 22 for controlling vertical displacement of the carriage 18 may be connected to either side of the carriage, FIG. 7 more explicitly depicts the axial shaft 214 of the pinion gear that enables this. The axial shaft 214 of the pinion gear for driving vertical displacement of the carriage 18 includes opposite ends extending substantially horizontally from opposite sides of the carriage 18. In each of the figures presented herein, the collar 22*c* (shown in FIG. 1A) of the lever 22 is attached to the end of the axial shaft 214 extending from the right-hand side of the carriage 18. With reference to FIG. 7 however, it should be appreciated that the collar 22*c* can easily be removed from the right-hand side of the shaft 214 and attached to the left-hand side of the shaft 214 to accommodate an operator seeking to manipulate the lever 22 with his/her left-hand.

Although the embodiments illustrated show the axial shaft 214 forming a polygonal protrusion over which the collar 22*c* is placed with an internal mating sleeve, it should be appreciated that any mating configuration may be used to join the shaft 214 and the collar 22*c* including the reverse relationship wherein the shaft 214 may have a recess for receiving a mating protrusion or projection from the collar 22*c* in order to form a mating engagement therebetween.

In summary, a mortiser according to the invention provides a number of generally novel features, which enhances the usability and operability of a power tool. For example, a mortiser according to the invention may include one or all of the described aspects of the invention, for example, a variable speed motor, the ability to sharpen tools directly on the power tool itself, and the novel hold-down or clamping arrangement for a workpiece to securely clamp a workpiece on the work table surface. It should further be noted that although the features and aspects of the invention have been specifically described with respect to a mortiser, certain of the features, in particular the features of the clamping arrangement and the sharpening system, can be used with and are applicable for use with other power tools, for example, with a drill presses if desired. Furthermore, while the features of the invention have been described as an apparatus, it should be understood that a number of novel methods are disclosed herein, including but not limited to a method for controlling the motor speed of a mortiser, a method for clamping a workpiece, and a method for sharpening tools on a power tool.

It will be appreciated that the above description of the present invention is susceptible to various modifications, changes and adaptations, and the same are intended to be comprehended within the meaning and range of equivalents of the appended claims.

What is claimed is:

1. A mortiser comprising:

a base for supporting a workpiece, the base having an upper and a lower surface;

a support extending from the base;

a carriage connected to the support and disposed above the base, the carriage having a motor with a chuck for driving an auger and a chisel lock for connecting a chisel thereto;

a clamp for retaining the workpiece on the base in at least one direction; and a fence connected to the base below the carriage and having an upstanding wall that is generally perpendicular to the upper surface of the base, the upstanding wall defining an opening through which at least a portion of the clamp is disposed;

wherein the fence includes a threaded post extending from the fence in substantial alignment with the opening defined by the upstanding wall, and the clamp further comprises:

a first body defining an opening through which the threaded post is disposed;

at least one arm extending from the first body for positioning over an upper surface of the workpiece to prevent the workpiece from lifting off of the base; and a second body threaded onto the post extending from the fence and abutting the first body to prevent the first body and arms extending therefrom from lifting off of the workpiece and capable of driving the arm into engagement with the workpiece to positively clamp the workpiece.

2. An apparatus according to claim 1 wherein the carriage is movable along the support toward and away from the base.

3. An apparatus according to claim 1 wherein the arm is movable with respect to the first body so that the clamp may be used to secure a variety of workpieces.

4. An apparatus according to claim 1 wherein the arm has a roller which allows the workpiece to be moved laterally under the clamp without releasing the clamp.

5. An apparatus according to claim 1 further comprising an integrated sharpening tool connected to the support to allow at least one of the chisel and auger to be sharpened directly thereon.

6. An apparatus according to claim 5 wherein the integrated sharpening tool comprises:

a first sharpening tool to perform a coarse sharpening task on the chisel or auger; and a second sharpening tool to perform a fine sharpening task on the chisel or auger.

7. An apparatus according to claim 5 wherein the integrated sharpening tool comprises at least one of a chisel cutter or sharpening cone.

8. An apparatus according to claim 1 further comprising a depth stop connected in substantial alignment with the carriage and support.

9. An apparatus according to claim 1 further comprising an integrated chisel positioning tool.

10. An apparatus according to claim 1 wherein the carriage has a handle for moving the carriage between a first position wherein the carriage is at an upper limit of travel and a second position wherein the carriage is at a lower limit of travel.

11. An apparatus according to claim 10 wherein the carriage has a first and second side and the handle has an elongated member with a grip on one end and a collar on the other end which is capable of being connected to either the first or second side of the carriage.

12. An apparatus according to claim 10 wherein the handle has an elongated member with a grip on one end and a collar on the other end which is capable of being connected to the carriage at a plurality of different angles.

13. An apparatus according to claim 1 wherein the fence is adjustably connected to the base below the carriage and movable toward and away from the support to selectively position the fence with respect to the base.

14. An apparatus according to claim 13 further comprising at least one handle for moving the fence toward and away from the support.

15. An apparatus according to claim 14 wherein the handle comprises a first handle extending from a first side of the support and a second handle extending from a second side of the support opposite the first, the handles being connected to a common drive mechanism for moving the fence toward and away from the support.

16. An apparatus according to claim 13 further comprising a fence clamp operably connected to the fence for securing the fence in a selected position.

17. An apparatus according to claim 16 wherein the fence clamp has a cam surface and is movable between a first position wherein the fence is movable with respect to the base and a second position wherein the fence is fixed with respect to the base.

18. A hollow chisel mortiser comprising:

a table having a flat substantially rectangular upper surface;

a post connected to the table adjacent one end thereof and extending in a direction transverse to the upper surface of the table;

a fence mounted on the upper surface of the table;

a clamping device fastened to the fence and positioned to permit clamping of a work-piece, which is disposed on the upper surface of the table adjacent the fence to the upper surface of the table;

a carriage mounted on the post and disposed above the upper surface of the table for movement along the post toward and away from the upper surface of the table;

a motor having a chucking device for holding a hollow mortising chisel mounted on the carriage for movement therewith; and a chisel sharpening tool in the form of a diamond cone sharpening tool mounted on the mortiser to permit sharpening of a chisel wherein the sharpening tool is mounted on the post.

19. The hollow chisel mortiser according to claim 18, wherein the sharpening tool is mounted on an end surface of the post.

20. A hollow chisel mortiser comprising:

a table having a flat substantially rectangular upper surface;

a post connected to the table adjacent one end thereof and extending in a direction transverse to the upper surface of the table;

a fence mounted on the upper surface of the table;

a clamping device fastened to the fence and positioned to permit clamping of a work-piece, which is disposed on the upper surface of the table adjacent the fence to the upper surface of the table;

a carriage mounted on the post and disposed above the upper surface of the table for movement along the post toward and away from the upper surface of the table;

a motor having a chucking device for holding a hollow mortising chisel mounted on the carriage for movement therewith; and, wherein the fence has a notch extending from an upper edge surface toward the upper surface of the table; and the clamping device is mounted on a support for the fence adjacent the notch and between the fence and the post, and has at least one arm that extends essentially parallel to the upper surface of the table toward and beyond the fence, either above the fence or through the notch, whereby a work-piece on the upper surface of the table adjacent the fence can be clamped to the upper surface of the table.

21. The hollow chisel mortiser according to claim 20, wherein there are two of said arms that are laterally spaced from each other and extend toward and beyond the fence essentially parallel to one another and to the upper surface of the table either above the fence or through the notch.

22. The hollow chisel mortiser according to claim 20, wherein said at least one arm has an L-shape with a long arm section and a short arm section, the short arm section being mounted for rotation about an axis parallel to the upper surface of the table and the long arm section extending toward and beyond the fence.

23. The hollow chisel mortiser according to claim 22, wherein there are two of said L-shaped arms, with the two said L-shaped arms each having the short arm section mounted for rotation about a respective axis parallel to the upper surface of the table and with the two said L-shaped arms each having the long arm section extending toward and beyond the fence.

24. The hollow chisel mortiser according to claim 23, wherein each of the short arm sections is provided with an elongated slot extending transverse to the axis of rotation so that the location of the axis relative to the length of the short arm section can be varied.

25. The hollow chisel mortiser according to claim 20, wherein said notch extends through said fence from said upper edge to an opposite edge adjacent the upper surface of the table.

26. A power tool comprising:

a mortiser having a base for supporting a workpiece, the base having an upper and a lower surface;

a support extending from the base;

a motor housing connected to the support and disposed above the base;

a motor that drives a motor shaft and is housed within the motor housing;

a hollow chisel in substantial alignment with the motor shaft;

an adjustable fence connected to the base below the motor housing and movable toward and away from the support to selectively position said fence with respect to the bases; and at least one rotatable handle operably connected to the support for moving the fence toward and away from the support comprising a first handle extending from a first side of the support and a second handle extending from a second side of the support wherein each of the first and second handles is coupled with a common drive mechanism such that the fence may be moved toward and away from the support using either handle.

27. An apparatus according to claim 26 further comprising:

at least one clamp mechanism operably connected to the fence capable of securing the fence to the base itself.

28. An apparatus according to claim 27 wherein the at least one clamp mechanism is capable of creating a clamping force that is substantially vertical to secure the fence to the base.

29. An apparatus according to claim 28 wherein the at least one clamp mechanism defines a cam surface, a handle, and a member extending downward from the handle toward the bottom surface of the base such that rotation of the at least one handle may constrain the fence or free the fence for adjustment depending on the direction of rotation.

30. An apparatus according to claim 1 wherein the apparatus further comprises at least one chisel assembly comprising:

a hollow chisel defining a sleeve adjacent an enlarged shoulder portion of the hollow chisel and at least one slot; and an auger disposed at least partially within the hollow chisel.

31. An apparatus according to claim 30 wherein the carriage defines an opening for receiving at least a portion of the chisel assembly and the apparatus further comprises an integrated chisel positioning tool operably connected to the carriage to space the shoulder portion of the hollow chisel from the carriage opening.

32. An apparatus according to claim 31 further comprising:

a bushing disposed at least partially within the carriage opening for receiving at least a portion of the sleeve of the hollow chisel.

33. A mortiser comprising:

a base for supporting a workpiece, the base having an upper and a lower surface;

a support extending from the base;

a carriage connected to the support and disposed above the base, the carriage having a motor with a chuck for driving an auger and a chisel lock for connecting a chisel thereto;

a clamp for retaining the workpiece on the base in at least one direction; and a fence connected to the base below the carriage and having an upstanding wall that is generally perpendicular to the upper surface of the base, the upstanding wall defining an opening through which at least a portion of the clamp is disposed;

wherein the carriage defines an opening for receiving at least a portion of a bushing and the apparatus further comprises:

a bushing disposed in the carriage opening; and an integrated chisel positioning tool operably connected to the carriage movable between a first position wherein the chisel positioning tool is placed in alignment with the carriage opening to space the chisel an appropriate distance from the carriage opening, and a second position wherein the chisel positioning tool is spaced apart from the bushing and chisel to avoid interfering therewith.

34. A mortiser according to claim 1 further comprising a speed control connected to the motor for selectively controlling the speed thereof.

35. The hollow chisel mortiser of claim 18, further comprising a control device mounted on the carriage and connected to the motor for selectively controlling the speed of the motor.

36. The hollow chisel mortiser of claim 20, further comprising a control device mounted on the carriage and connected to the motor for selectively controlling the speed of the motor.

37. The power tool of claim 26, further comprising a variable speed control for selectively controlling the speed of the motor.

38. The mortiser of claim 33, wherein the integrated chisel positioning tool includes at least one spacer having a body with a thickness to space the chisel from the carriage opening.

39. The mortiser of claim 38, wherein the at least one spacer includes first and second spacers with bodies respectively having first and second thicknesses for spacing the chisel from the carriage opening.

40. The mortiser of claim 39, wherein the first and second spacers are integrally connected to one another and pivotally mounted to the carriage to selectively put the first or second spacer into alignment with the carriage opening to space the chisel from the carriage opening.

41. The mortiser of claim 39, wherein the first and second thicknesses of the spacer bodies are different from one another for spacing the chisel at different distances from the carriage opening.

42. The mortiser of claim 38, wherein the at least one spacer includes an arcuate portion for engaging with a corresponding arcuate portion of the chisel.

43. The mortiser of claim 39, wherein the first and second spacers are two separate bodies operably connected to the carriage such that they may be independently moved between the first and second positions thereof.

44. The mortiser of claim 43, wherein the first and second spacers are operably connected to the carriage via a shaft about which the first and second spacers may pivot between the first and second positions thereof.

* * * * *

UNITED STATES PATENT AND TRADEMARK OFFICE

CERTIFICATE OF CORRECTION

PATENT NO. : 7,509,984 B2
APPLICATION NO. : 11/299479
DATED : March 31, 2009
INVENTOR(S) : Barry M. Schwaiger and William J. Phillips It is certified that error appears in the above-identified patent and that said Letters Patent is hereby corrected as shown below:

Column 18, claim 26, line 62, change “bases” to -- base --.

Signed and Sealed this

Twenty-sixth Day of May, 2009

JOHN DOLL
*Acting Director of the United States Patent and Trademark Office*